US012269565B1

(12) United States Patent
Durst

(10) Patent No.: US 12,269,565 B1
(45) Date of Patent: Apr. 8, 2025

(54) VARIABLE BALLAST PROPULSION SHIPPING VESSEL, SYSTEMS AND METHODS

(71) Applicant: Seatrain Technology, LLC, Boynton Beach, FL (US)

(72) Inventor: Randy Durst, Boynton Beach, FL (US)

(73) Assignee: SEATRAIN TECHNOLOGY, LLC, Boynton Beach, FL (US)

( * ) Notice: Subject to any disclaimer, the term of this patent is extended or adjusted under 35 U.S.C. 154(b) by 0 days.

(21) Appl. No.: 18/834,219

(22) PCT Filed: Nov. 14, 2023

(86) PCT No.: PCT/US2023/037256
§ 371 (c)(1),
(2) Date: Jul. 29, 2024

(51) Int. Cl.

| | |
|---|---|
| ***B63B 43/06*** | (2006.01) |
| ***B63B 1/32*** | (2006.01) |
| ***B63B 13/00*** | (2006.01) |
| ***B63H 25/38*** | (2006.01) |

(52) U.S. Cl.
CPC ..... *B63B 43/06* (2013.01); *B63B 1/322* (2013.01); *B63B 13/00* (2013.01); *B63H 25/38* (2013.01)

(58) Field of Classification Search
CPC ..... B63B 43/06; B63B 1/322; B63B 13/00; B63H 25/38
See application file for complete search history.

(56) References Cited

U.S. PATENT DOCUMENTS 3,478,711 A 11/1969 Combs
3,648,635 A * 3/1972 Hashemi ..... B63G 8/001 114/244
3,809,002 A 5/1974 Nagy et al.
3,868,920 A 3/1975 Schirtzinger
4,108,101 A 8/1978 Schirtzinger
(Continued)

FOREIGN PATENT DOCUMENTS

CN 106043632 A 10/2016
GB 2163114 A * 2/1986 ..... B63C 11/42

OTHER PUBLICATIONS

International Search Report of the International Searching Authority mailed on Mar. 25, 2024 and issued in PCT/UD2023/037256, filed on Nov. 14, 2023.

*Primary Examiner* — Stephen P Avila
(74) *Attorney, Agent, or Firm* — Sagacity Legal PLLC

(57) ABSTRACT

A variable ballast propulsion shipping vessel comprising a lead segment, a cargo segment(s), and/or a tail segment hingedly attached in series. Each lead and cargo segment includes a bottom-mounted fixed ballast, a top-mounted dorsal wing with rudder, and side mounted pairs of planed wings projecting laterally (fixed or stowable). An onboard variable ballast tank is selectively air filled using a compressed air compartment and water filled/exhausted using a ballast port(s). An battery bank is charged by an battery charger (e.g., using impellers) and powers an air compressor, rudder and/or planes. A cargo bay in the cargo segment(s) is accessible through a cargo door, a hatch, and/or a capped filler neck. A shipping vessel control system creates and distributes control commands (through wired and/or wireless interfaces) to selectively operate the respective ballast tanks of the lead and cargo segments to change travel state among positive, negative, and neutral buoyancies.

18 Claims, 16 Drawing Sheets

(56) References Cited

U.S. PATENT DOCUMENTS

| | | | |
|---|---|---|---|
| 6,182,593 | B1 | 2/2001 | Wierick |
| 6,923,693 | B2 | 8/2005 | Borgen et al. |
| 8,205,570 | B1 | 6/2012 | Tureaud et al. |
| 10,967,944 | B2 | 4/2021 | Garthwaite |
| 11,505,297 | B2 | 11/2022 | Chelaru |
| 2005/0166827 | A1 | 8/2005 | Holmes |
| 2012/0015567 | A1 | 1/2012 | Herbek et al. |
| 2023/0191861 | A1 | 6/2023 | Tan et al. |

* cited by examiner

VARIABLE BALLAST PROPULSION SHIPPING VESSEL, SYSTEMS AND METHODS

CROSS REFERENCE TO RELATED APPLICATIONS

The present application is a U.S. Non-Provisional applications submitted to the United States/Elected Office under 35 U.S.C. 371, which claims the benefit of International Application No. PCT/US2023/037256, filed Nov. 14, 2023, entitled "Variable Ballast Propulsion Shipping Vessel, Systems and Methods", which are incorporated by reference herein in their entirety.

FIELD OF THE INVENTION

The present invention relates generally to ocean freight shipping technology. More particularly, this invention pertains to assemblies, systems, and methods for maritime autonomous cargo shipping in both surfaced and submerged modes.

BACKGROUND OF THE INVENTION

Approximately 80 percent of goods constituting global trade are transported by ocean shipping, most carried inside 40-foot-long steel containers stacked by the thousands atop some of the largest vessels in the world. Between 1990 and 2021, the volume of cargo transported by ships grew from 4 billion tons to nearly 11 billion tons. Nearly 69 percent of all the goods traded by the United States of America are transported via waterways, predominantly by seagoing vessels. Ships transport over 41 percent of the total value of goods traded by the United States.

The supply chain delays caused by the coronavirus pandemic underscored both how crucial the maritime container trade is to the global economy, and how vulnerable ocean shipping is to catastrophic disruption. Pandemic-driven challenges caused the cost of shipping a container on the world's transoceanic trade routes to increase seven-fold in the 18 months following March 2020, while the cost of shipping bulk commodities spiked even more. Ship chartering costs surged by up to 773% since late May 2020. Marine fuel costs near tripled from $155.5 per metric ton in April 2020 to $435.5 per metric ton currently. The one-day cost of operating a 4,250-box ship spiked during that time from about $30,200 per day in mid-June 2020 to about $151,400 a day currently.

Ocean shipping at such a large scale has significant environmental impact, are responsible for more than 18 percent of certain air pollutants, including greenhouse gas emissions. The International Maritime Organization (IMO) estimates that carbon dioxide emissions from shipping were equal to 2.2% of the global human-made emissions in 2012 and expects such including air pollution, water pollution, acoustic noise, and oil pollution. Ships 30 emissions to rise 50 to 250 percent by 2050 if no action is taken.

What is needed are alternative systems and methods for timely, reliable, and affordable delivery of bulk freight and/or goods containers via ocean shipping. Specifically, ocean-going vessel designs that produce little or no hydrocarbons and, ideally, that do not use fossil fuels for propulsion are desired. Besides being more environmentally friendly, employment of engines that do not burn fossil fuels holds promise for propulsion means that are less expensive to build, maintain, and/or repair than legacy engine technologies. Vessel designs with the advantage of autonomous control may be deployed without a manned crew, further lowering operating costs and eliminating human error. Vessel designs that support submerged mode operation may provide a safer method of transporting cargo across oceans due to natural protection from surface storms and high seas.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

A variable ballast propulsion shipping vessel according to an embodiment of the present invention may be characterized by a lead segment, one or more cargo segments, and/or a tail segment mechanically and hingedly attached in series. Respective slipstream covers may be mounted between adjacent segments in the series.

Each cargo segment may comprise a cargo segment body including a bottom-mounted fixed ballast, a top-mounted dorsal wing having a rudder, and side-mounted pairs of wings projecting laterally from opposing sides of the cargo segment body and each having a respective plane. The side wings may be fixed or, alternatively, may be stowable through retraction and/or folding. Each cargo segment may carry a variable ballast tank and a compressed air compartment configured to transfer air into the variable ballast tank; an air compressor configured to air fill the compressed air compartment; and a ballast port(s) configured both to water intake and to water exhaust the variable ballast tank. A battery bank onboard each cargo segment may be configured to deliver power to the cargo segment's air compressor, as well as to the cargo segment's rudder and/or planes. An onboard battery charger may be configured to translate current from an impeller(s) for storage into the battery bank. At least one of a cargo door, a hatch, and/or a capped filler neck may be positioned for access to a cargo bay(s)/tank(s) inside the cargo segment body.

The lead segment may comprise a lead segment body including a bottom-mounted fixed ballast, a top-mounted dorsal wing having a rudder, and side-mounted pairs of wings projecting laterally from opposing sides of the lead segment body and each having a respective plane. The side wings may be fixed or, alternatively, may be stowable through retraction and/or folding. The lead segment may carry a variable ballast tank and a compressed air compartment configured to transfer air into the variable ballast tank; an air compressor configured to air fill the compressed air compartment; and a ballast port(s) configured both to water intake and to water exhaust the variable ballast tank. A battery bank onboard the lead segment may be configured to deliver power to the lead segment's air compressor, as well as to the lead segment's rudder and/or planes. An onboard battery charger may be configured to translate current from an impeller(s) for storage into the battery bank.

The lead segment and/or the tail segment may further comprise a shipping vessel control system configured to create control commands to selectively operate the respective ballast tanks of the lead and cargo segments to alter a respective travel state of each of the lead and cargo segments among a positive buoyancy, a negative buoyancy, and a neutral buoyancy. The shipping vessel control system may be powered by the onboard battery bank of the hosting segment and may be configured in data communication with the cargo segment(s) by a wired interface and/or a wireless interface coupled to form a communications bus.

In a method aspect of the present invention, the shipping vessel control system may comprise instructions stored in a non-transitory computer-readable storage medium and which, when executed by a computer processor, may selectively operate the cargo segment(s) by (1) receiving a subroute comprising a target peak, a target trough, a target course, and a target waypoint; and (2) while a travel state of the cargo segment shows an actual position not equal to the target waypoint, operating each of the cargo segment(s), in turn, as mechanically and hingedly attached in the series, by (A) transmitting, upon detection of an on target condition between a target depth and an actual depth of the travel state, a set neutral buoyancy command; (B) transmitting, upon detection of a positive delta between the target trough and the actual depth of the travel state, a set negative buoyancy command; (C) transmitting, upon detection of a negative delta between the target peak and the actual depth of the travel state, a set positive buoyancy command; (D) transmitting, upon detection of an on course condition between the target course and an actual heading of the travel state, a maintain heading command; (E) transmitting, upon detection of a port delta between the target course and the actual heading of the travel state, a starboard turn command; and (F) transmitting, upon detection of a starboard delta between the target course and the actual heading of the travel state, a port turn command.

The set positive buoyancy command may operate the receiving cargo segment by air filling the variable ballast tank(s), pairedly articulating the planes to up position, and articulating the rudder to laterally nominal position. The set negative buoyancy command may operate the receiving cargo segment by water filling the variable ballast tank(s), pairedly articulating the planes to down position, and articulating the rudder to the laterally nominal position. The set neutral buoyancy command may operate the receiving cargo segment by holding the variable ballast tank(s), pairedly articulating the planes to vertically nominal position, and articulating the rudder to the laterally nominal position. The port turn command may operate the receiving cargo segment by articulating the rudder to port position. The starboard turn command may operate the receiving cargo segment by articulating the rudder to starboard position. The maintain heading command may operate the receiving cargo segment by articulating the rudder to the laterally nominal position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

As used herein, like reference numerals refer to like parts throughout the several views of the drawings.

DETAILED DESCRIPTION OF THE INVENTION

Figure 1:
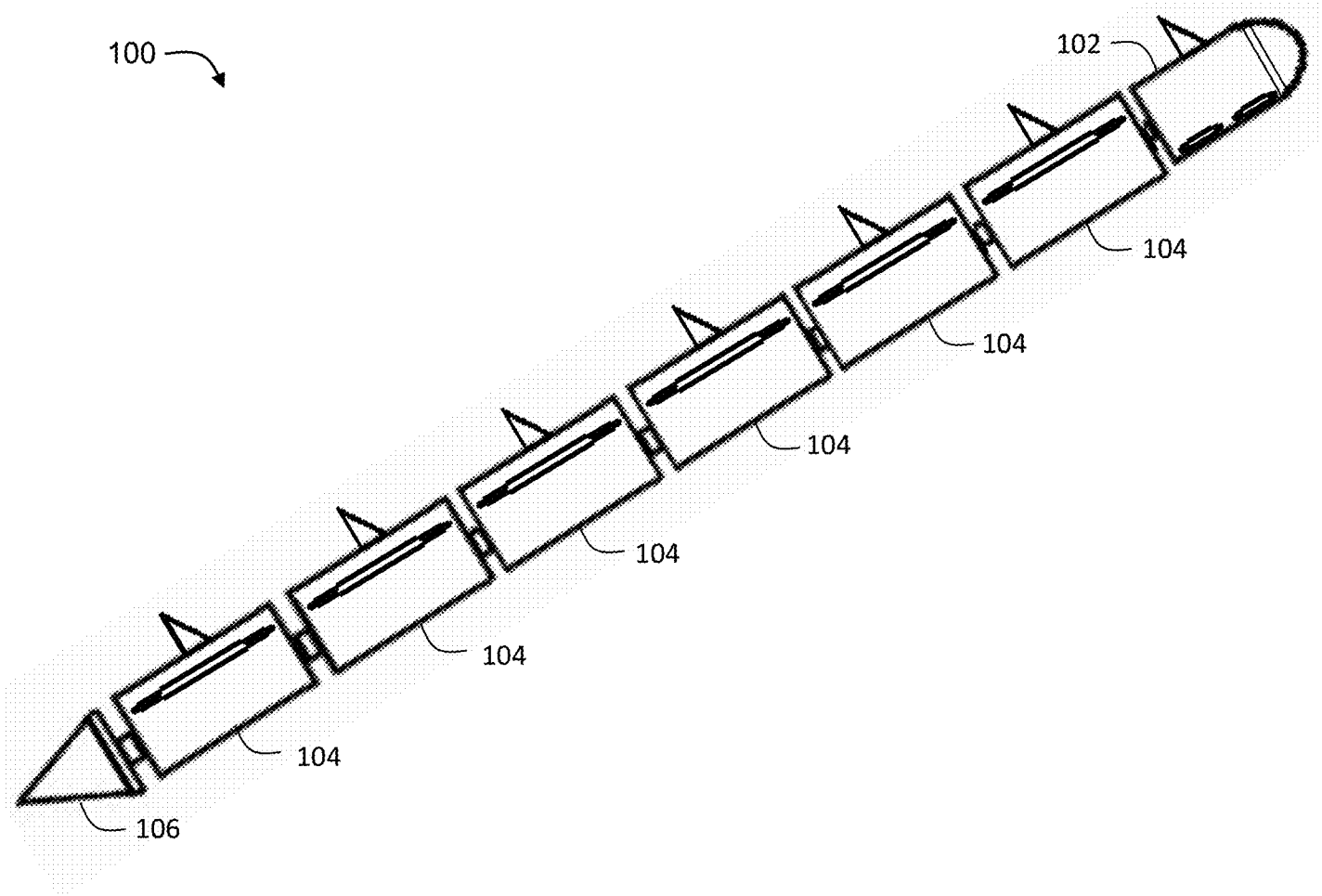
FIG. 1 is a side elevation view schematic diagram of a variable ballast propulsion shipping vessel according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

In general, the present invention relates to a variable ballast propulsion submersible vessel for transporting removable cargo (e.g., fluid or dry bulk freight, goods in shipping containers). The submersible may comprise substantially identical water-tight, cargo-carrying segments connected sequentially by respective mating hinge mechanisms. Each segment may be selectively attached and detached from the next adjacent segment, allowing variable length "trains" to be assembled and moved by water in both submerged and surfaced modes.

Each cargo segment may be largely a slave to external control by a detachable bow- and/or stem-based computerized control system (e.g., an onboard computer, local area network, and long-haul communication link to a remote navigation system; alternatively, an onboard computer and stored navigation data and undersea topographical maps, to govern navigation along a pre-recorded sail plan; also alternatively, an on-board computer monitoring onboard environmental sensors and executing real-time autonomous navigation rules (e.g., artificial intelligence) to determine and execute a non-recorded sail plan).

In certain embodiments, the assembled vessel may be designed to operate at depths from 3 to 20,000 feet while underway for long-haul navigation. At both the beginning and end of a delivery "sortie", the assembled vessel may operate in surfaced mode in and around a port area, optionally assisted by one or more local port-based service vessels capable of towing assembled (e.g., "trains") and/or individual sections of the vessel segments loaded with cargo. As the segments are quickly unloaded and reloaded, they may be reattached as part of a train supporting another delivery sortie. The port-based service vessel(s) may tow assembled segments from an origination port area back out to sea where the reloaded vessel may then be sent on its way to the next required delivery destination. One cargo-carrying segment operated by a lead segment (e.g., by the onboard control system) may be a theoretical minimum number of segments required for certain embodiments of the present invention to operate (e.g., to create variable buoyancy motion).

Variable ballast propulsion may be defined as the bow- and/or stem-based computer-based control system coordinating oscillation of the respective ballasts present in each cargo segment of an assembled train of cargo segments. The timing of electrically triggered ballast intake and exhaust ports onboard each cargo segment may create an underwater gliding up and down motion among the train of cargo segments. The control system may similarly operate directional components present on the external structure of each cargo segment in the train. Such components may translate the simple up and down motion created by a given cargo segment into pitch (e.g., planes actuating from paired, side-mounted wings) and/or yaw (e.g., a rudder actuating from a dorsal wing).

More specifically, computer-based control system may cause water to enter a ballast tank of a given segment, creating negative buoyancy. Now in a negative buoyancy state, the segment may descend on a glide path to a predetermined depth before the computer-based control system may suddenly cause air to be pumped into the ballast tank of the segment to change the buoyancy state to positive. Behaving much like a glider, the computer-based control system may electrically trigger the aerodynamic features (e.g., planes, rudders) of each cargo segment to exploit both its negative and positive buoyancy states by translating the either downward or upward acceleration into a desired direction (as a combination of pitch and/or yaw). Emergency system failures may be dealt with by a depth sensor that may trigger airbags to be deployed past a certain depth and/or when desired forward motion is somehow lost.

In certain embodiments, the minimal power source onboard a given cargo segment to operate the variably buoyancy propulsion "engine" is an electric battery that may be recharged while the segment is underway, for example, using impellers mounted on the respective sides/top of each segment and electrically connected to small battery chargers (e.g., alternators). Designs that use battery power to manipulate ballast equipment onboard individual segments may advantageously result in a vessel that uses less hydrocarbons than legacy container ships. Battery-stored electrical power on each segment alternatively may be replenished by optional onboard charging systems such as solar panels (e.g., when a vessel is surfaced), water or wind turbine chargers (e.g., when moving underwater or when surfaced in moving air), and/or inverter/charger (e.g., when connected to shore power).

Without the need for fossil fuels for propulsion, the present shipping design may be much more environmentally friendly than traditional shipping options. Without the need for engines burning fossil fuels, the need for expensive and reoccurring maintenance and/or repairs of engines and equipment may advantageously be reduced. The vessel described herein may be autonomous and requires no crew, further lowering costs, and may be a vastly safer method of transporting cargo across oceans and seas due to the submersible capabilities of the vessel (i.e., no need to contend with storms and surface waves, with reefs and obstructions, and/or with shallow water).

Referring initially to FIG. 1, a variable ballast propulsion shipping vessel 100 according to an embodiment of the present invention will now be described in detail. In the exemplary configuration of FIG. 1, the shipping vessel 100 may comprise a lead segment 102 mechanically attached to a first of some number of cargo segments 104 which are mechanically attached to each other, in series, before ending with a mechanically attached tail segment 106.

Figure 2:
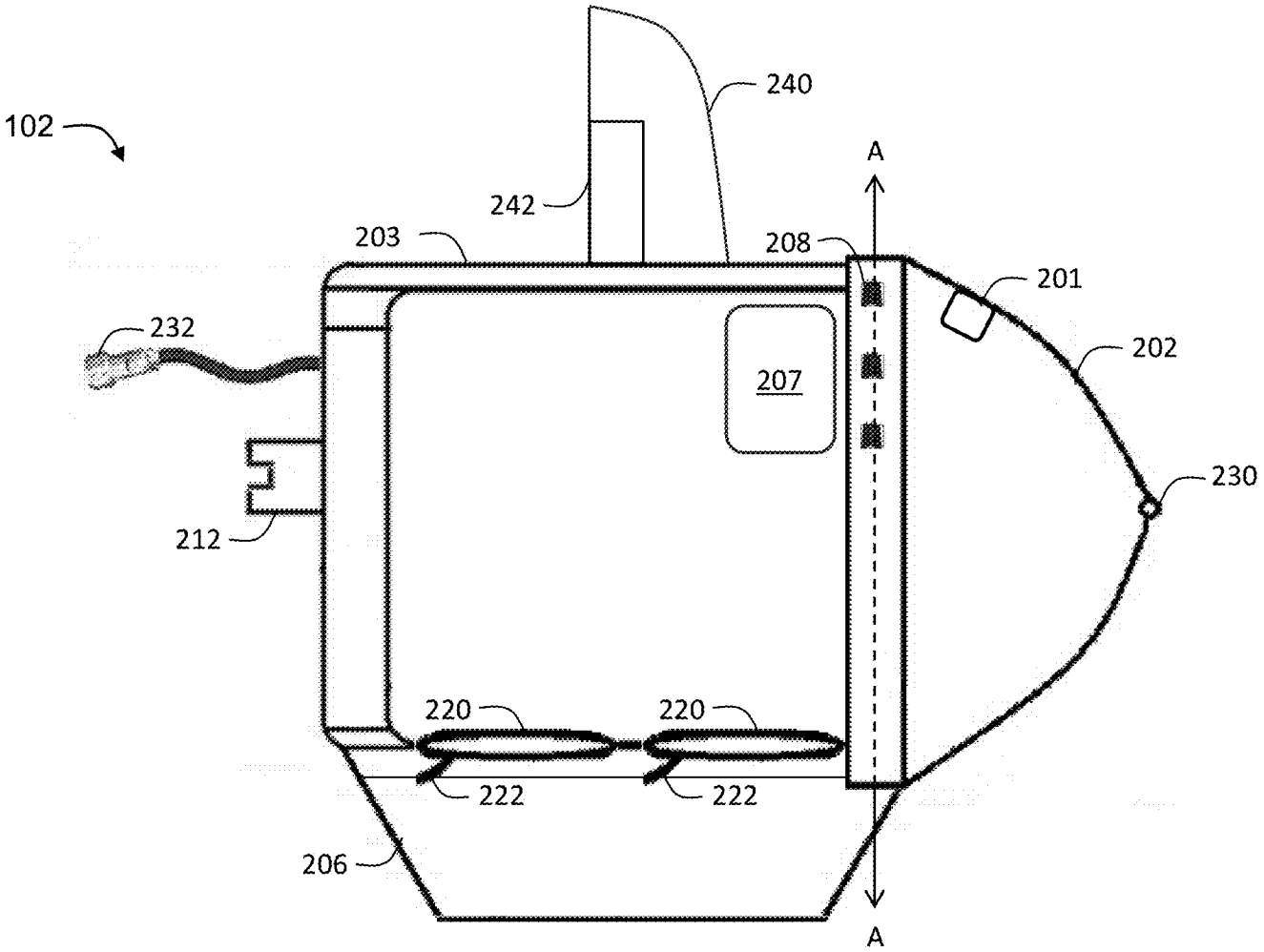
FIG. 2 is a side elevation view schematic diagram of an exemplary lead segment of the variable ballast propulsion shipping vessel of FIG. 1.

Still referring to FIG. 1, and referring additionally to FIG. 2, the lead segment 102 may be characterized by a superstructure comprising a nose cone 202 (i.e., defining a bow) mounted forward of a lead body portion 203. A fixed ballast 206 may be mounted to a bottom of the lead body portion 203, for example, and without limitation, to maintain stability of the lead segment 102 when operating both in submerged and surfaced modes. An aft hinge mechanism 212 may be mounted to the lead body portion 203 opposite the nose cone 202, for example, and without limitation, to facilitate mechanical attachment to an assembled "train" of vessel segments 104, 106 to be operated by the lead segment 102.

Figure 3:
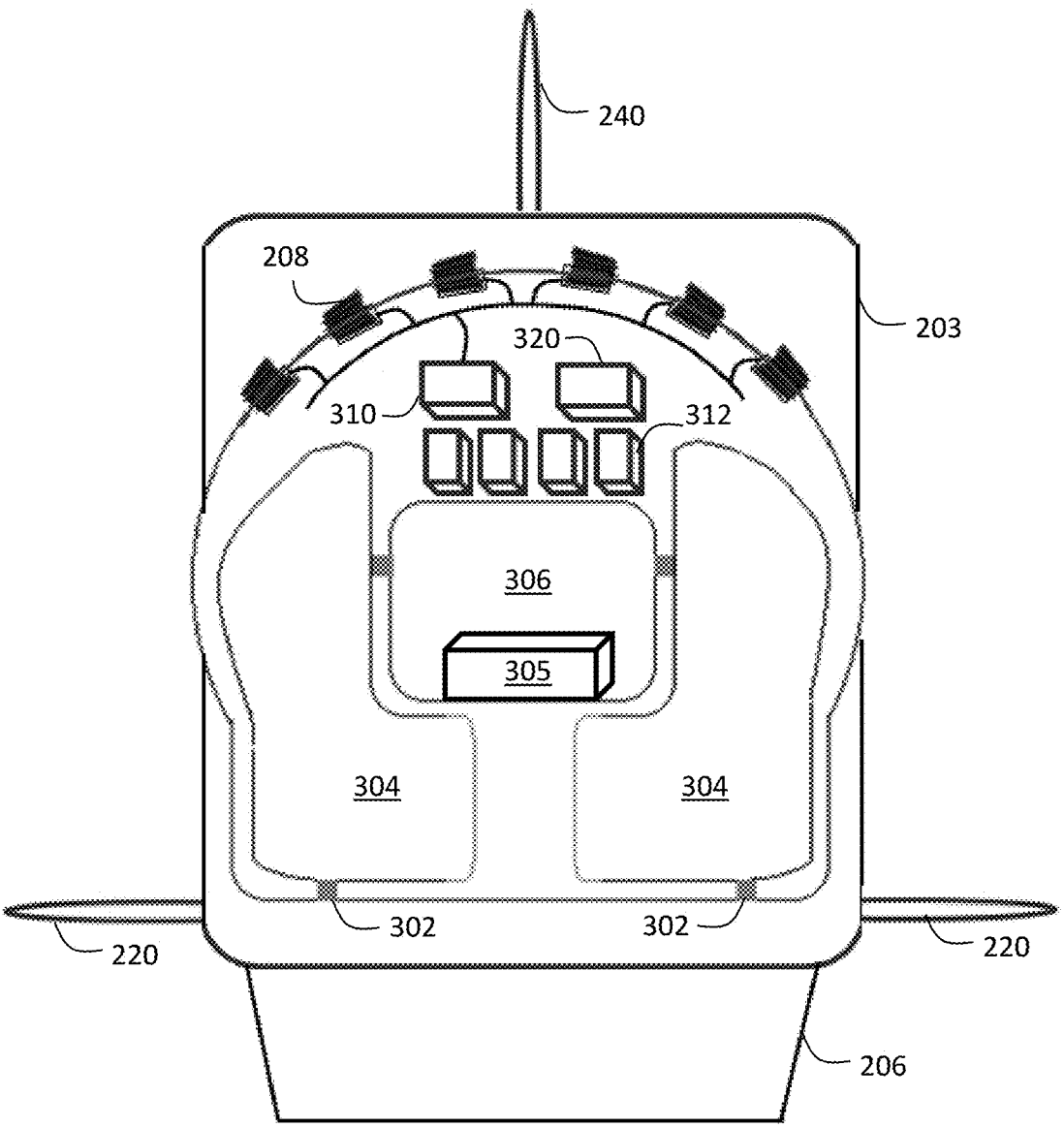
FIG. 3 is a front elevation cross-section view schematic diagram of the exemplary lead segment of FIG. 2 as viewed through line A-A.
Figure 4:
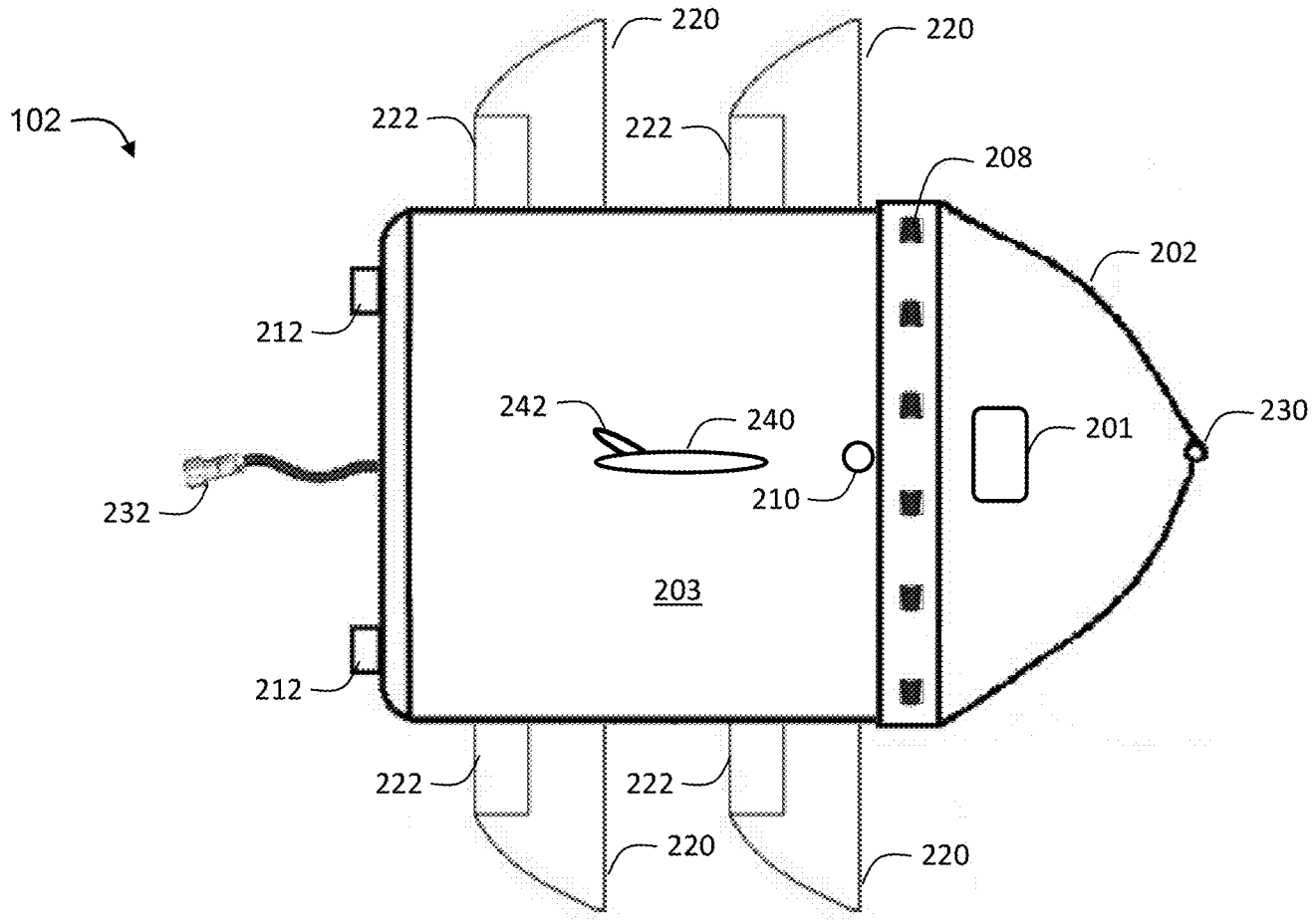
FIG. 4 is a top elevation view schematic diagram of the exemplary lead segment of FIG. 2 with wings deployed.
Figure 5:
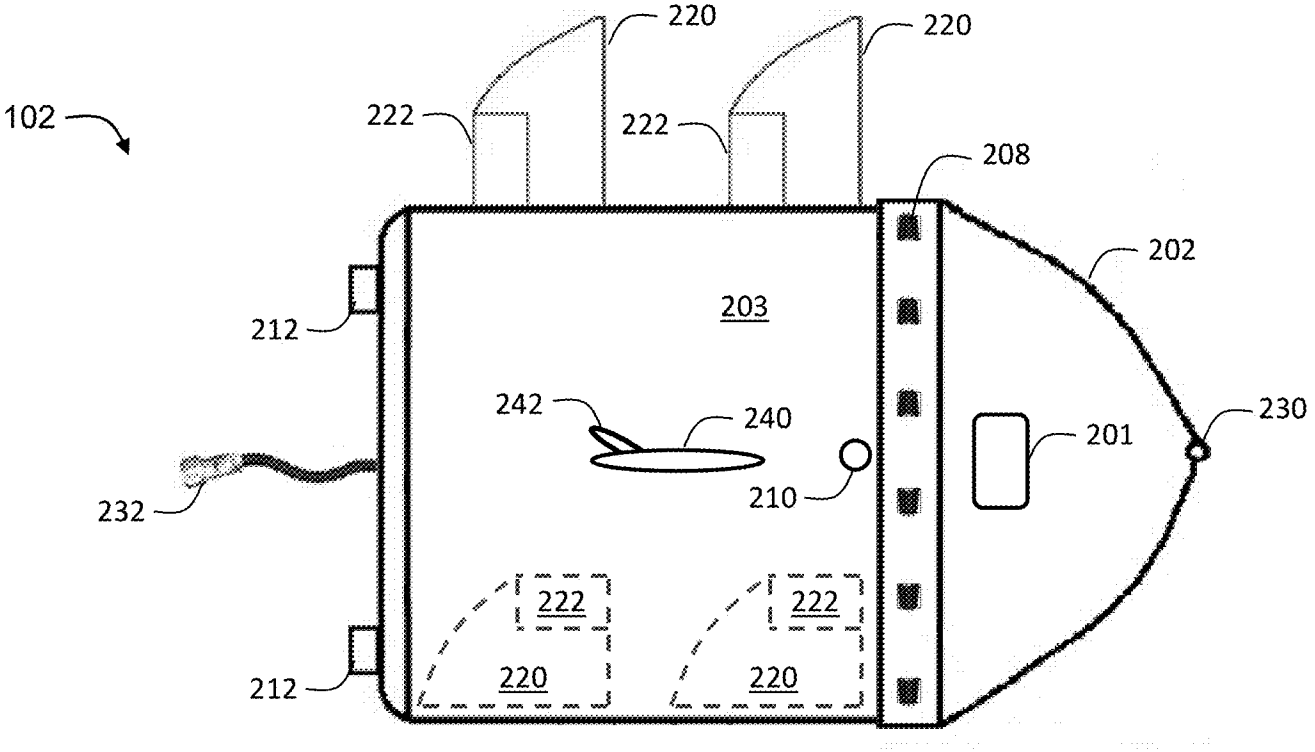
FIG. 5 is a top elevation view schematic diagram of the exemplary lead segment of FIG. 2 with starboard wings retracted.

Still referring to FIG. 2, and referring additionally to FIGS. 3, 4 and 5, the lead segment 102 may further comprise some number of port and starboard glide wings 220 configured to project pairedly and laterally (with respect to a centerline) from the lead body portion 203. The exemplary embodiment illustrated in FIGS. 2, 3, 4 and 5 comprises two pairs of glide wings 220 (four wings total). Those skilled in the art will readily appreciate that lead segment 102 designs, as well as cargo segment 104 designs described hereinbelow, may comprise a single pair of wings, or three (3) or more pairs of wings, while still accomplishing the many goals, features and advantages according to the present disclosure.

As illustrated in FIG. 3, each of the glide wings 220 may present a respective substantially flat bottom surface which may augment a substantially flat bottom of the fixed ballast 206 to present a hydrodynamic glide effect when the lead segment 102 is underway, and particularly in submerged mode. Each glide wing 220 may include at least one plane 222 that may be operated in combination with the wing planes 222 of the other glide wings 220 deployed, for example, and without limitation, to control lead segment 102 pitch and, with forward motion, to control lead segment 102 depth. Additionally, a dorsal wing 240 having a rudder 242 may be mounted to a top of the lead body portion 203, for example, and without limitation, to provide a primary control surface for selectively steering the lead segment 102 generally to port and/or to starboard.

Various accessories mounted on an exterior of lead segment 102 each may be configured as watertight assemblies to prevent water intrusion. For example, and without limitation, a navigation light 230 may be mounted at the bow of nose cone 202 for use as a safety beacon during night or reduced visibility navigation. Also, for example, and without limitation, environmental profiling gear 201 (e.g., instruments for measuring temperature, salinity, and/or pressure) may be mounted external to the nose cone 202 and/or to the lead body portion 203. Also, for example, and without limitation, a networking cable with plug 232 may be mounted at the stern of the lead body portion 203 for use in delivery of electric power and/or communication signals to "train" vessel segments 104, 106, as described in more detail hereinbelow. The lead segment 102 may further comprise an access panel 207 that may be opened when the lead segment 102 is in surfaced mode or when dry docked to allow maintenance access to components and systems that may be deployed either partially or fully inside the superstructure 202, 203 of the lead segment 102. For example, and without limitation, some number of impellers 208 may be configured to partially project from the exterior of lead segment 102 to translate movement of the lead segment 102 in submerged mode into spinning of the impeller(s) that, in turn, may be converted by a battery charger 310 into electrical current for power storage into an onboard battery bank 312.

The battery bank 312 may be used to power various substantially mechanical onboard systems including motors (not shown) used to actuate the planes 222 of the glide wings 220, and/or rudder(s) 242 of the dorsal wing(s) 240. Other substantially mechanical onboard systems powered by the battery bank 312 may include ballast intake(s)/exhaust(s) 302 used to selectively receive or expel water into/out of a variable ballast tank(s) 304; an air compressor 305 used to fill a compressed air tank 306 from which air may be introduced into the variable ballast tank(s) 304 to expel water for purposes of changing buoyancy of the lead segment 102; and a motor (not shown) used to actuate retractable and/or stowable components such as a global positioning system (GPS) antenna 210, the glide wings 220 (showing starboard wings retracted in FIG. 5), and/or the dorsal wing 240. The battery bank 312 also may be used to power shipping vessel control system 320 components and electronic devices (e.g., on-board computer, local area networking, long-haul communications, onboard sensors).

Figure 6:
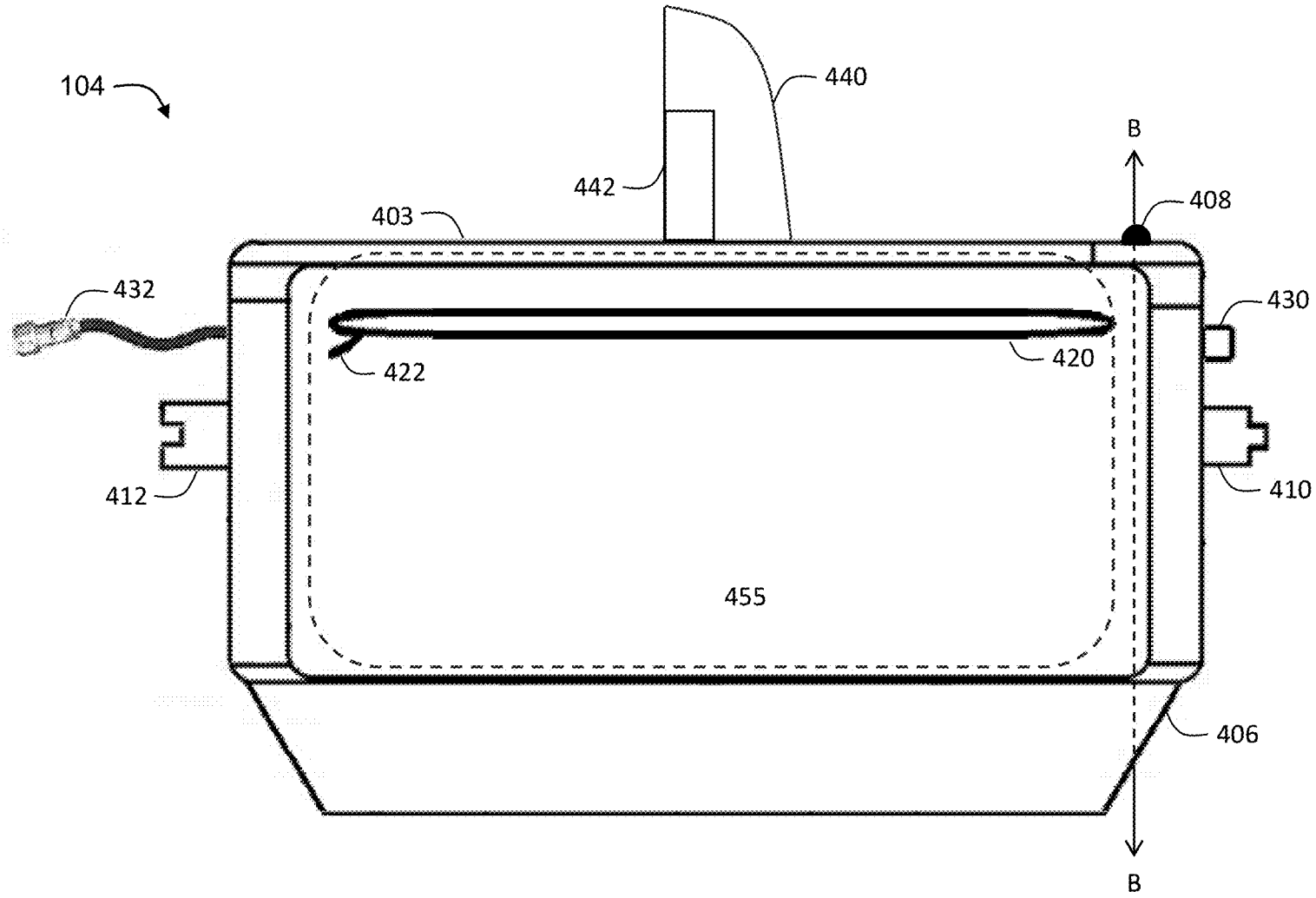
FIG. 6 is a side elevation view schematic diagram of an exemplary cargo segment of the variable ballast propulsion shipping vessel of FIG. 1.
Figure 7:
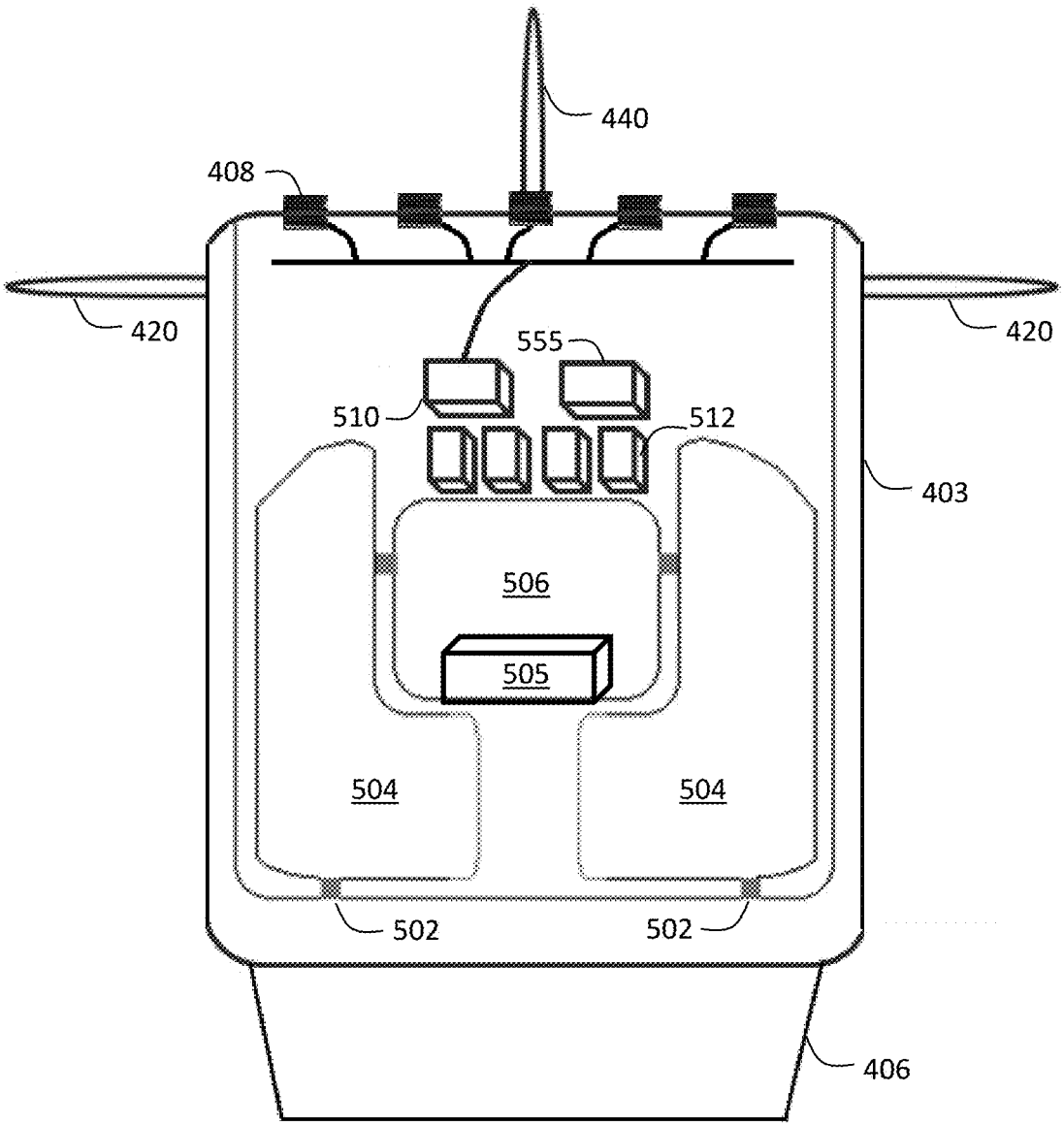
FIG. 7 is a front elevation cross-section view schematic diagram of the exemplary cargo segment of FIG. 6 as viewed through line B-B.
Figure 8:
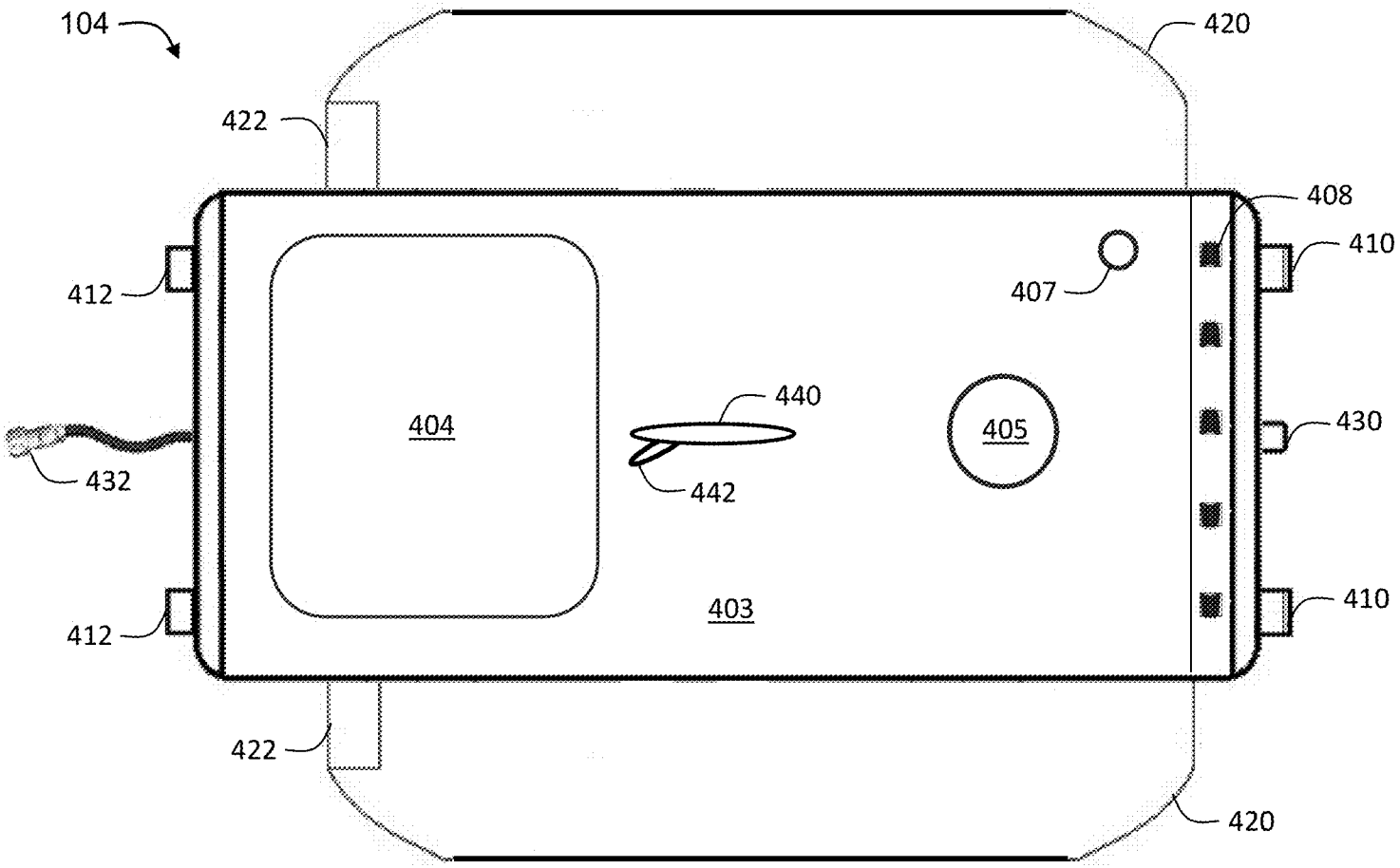
FIG. 8 is a top elevation view schematic diagram of the exemplary cargo segment of FIG. 6.

Referring now to FIGS. 6, 7 and 8, each cargo segment 104 may be characterized by a superstructure comprising a cargo body portion 403 that may include at least one sealable access mechanism. For example, and without limitation, a cargo door 404 may be configured for top loading/unloading of cargo organized into containers shaped to substantially fit an interior cargo bay 455 of the cargo body portion 403). Also for example, and without limitation, a hatch 405 and/or a capped filler neck 407 may be configured for fill and/or retrieval of loose bulk cargo (e.g., grain, sand, gravel) and/or fluid cargo (e.g., oil, gas) to/from any number of advantageously arranged onboard cargo tanks 455. A person of skill in the art will immediately recognize that an advantageous implementation of needed sealable access mechanisms may be bottom-mounted (e.g., for gravity drain) rather than and/or in addition to top-mounted on the cargo body portion 403.

A fixed ballast 406 may be mounted to a bottom of the cargo body portion 403, for example, and without limitation, to maintain stability of the cargo segment 104 when operating both in submerged and surfaced modes. A forward hinge mechanism 410 and an aft hinge mechanism 412 may be mounted to a bow and a stern, respectively, of the cargo body portion 403, for example, and without limitation, to facilitate mechanical attachment in line as part of the assembled "train" of vessel segments 104, 106 as operated by the lead segment 102. Each cargo segment 104 may further comprise some number of port and starboard glide wings 420 configured to project pairedly and laterally (with respect to a centerline) from the cargo body portion 403. Each of the glide wings 420 may present a respective substantially flat bottom surface which may augment a substantially flat bottom of the fixed ballast 406 to present a hydrodynamic glide effect when the cargo segment 104 is underway in submerged mode. Each glide wing 420 may include at least one plane 422 that may be operated in combination with the wing plane(s) 422 of the other glide wing(s) 420 deployed, for example, and without limitation, to control cargo segment 104 pitch and, with forward motion, to control cargo segment 104 depth. Additionally, a dorsal wing 440 having a rudder 442 may be mounted to a top of the cargo body portion 403, for example, and without limitation, to provide a primary control surface for selectively steering the cargo segment 104 generally to port and/or to starboard.

Various accessories mounted on an exterior of cargo segment 104 each may be configured as watertight assemblies to prevent water intrusion. For example, and without limitation, a networking cable receptacle 430 may be mounted forward on the cargo body portion 103; and a networking cable with plug 432 may be mounted at the stern of the cargo body portion 403. A reconfigurable bus for delivery of electric power and/or communication signals from lead segment 102 to a "train" of cargo segments 104 may be formed by using each networking cable receptacle 430 to fittedly receive the respective networking cable with plug 432 of the adjacent vessel segment 102, 104 in the assembled "train.

Each cargo segment 104 may further comprise components and systems that may be deployed either partially or fully inside the cargo body portion 403 of cargo segment 104. For example, and without limitation, some number of impellers 408 may be configured to partially project from the exterior of cargo segment 104 to translate movement of the cargo segment 104 in submerged mode into spinning of the impeller(s) 408. Similar to the description above for the lead segment 102, the spinning of the impeller(s) 408, in turn, may be converted by a battery charger 510 into electrical current for power storage into an onboard battery bank 512. This battery bank may be used to power various substantially mechanical systems onboard cargo segment 104 including motors (not shown) used to actuate the planes 422 of the glide wings 420, and/or rudder(s) 442 of the dorsal wing(s) 440. Other substantially mechanical systems onboard the cargo segment 104 and powered by the battery bank 512 may include motors (not shown) used to actuate ballast ports 502 used to selectively receive or expel water into/out of a variable ballast tank(s) 504; an air compressor 505 used to fill a compressed air tank 506 from which air may be introduced into the variable ballast tank(s) 504 to expel water for purposes of changing buoyancy of the cargo segment 104; and a motor (not shown) used to actuate retractable and/or stowable components such as the glide wings 420 (showing starboard wing folded in FIG. 15) and/or the dorsal wing 440. The battery bank 512 also may be used to power electronic devices (e.g., actuator/ballast controls, local area networking relays, sensors) found onboard the cargo segment 104 that may be largely operated by the shipping vessel control system 320 of the lead segment 102.

Figure 9:
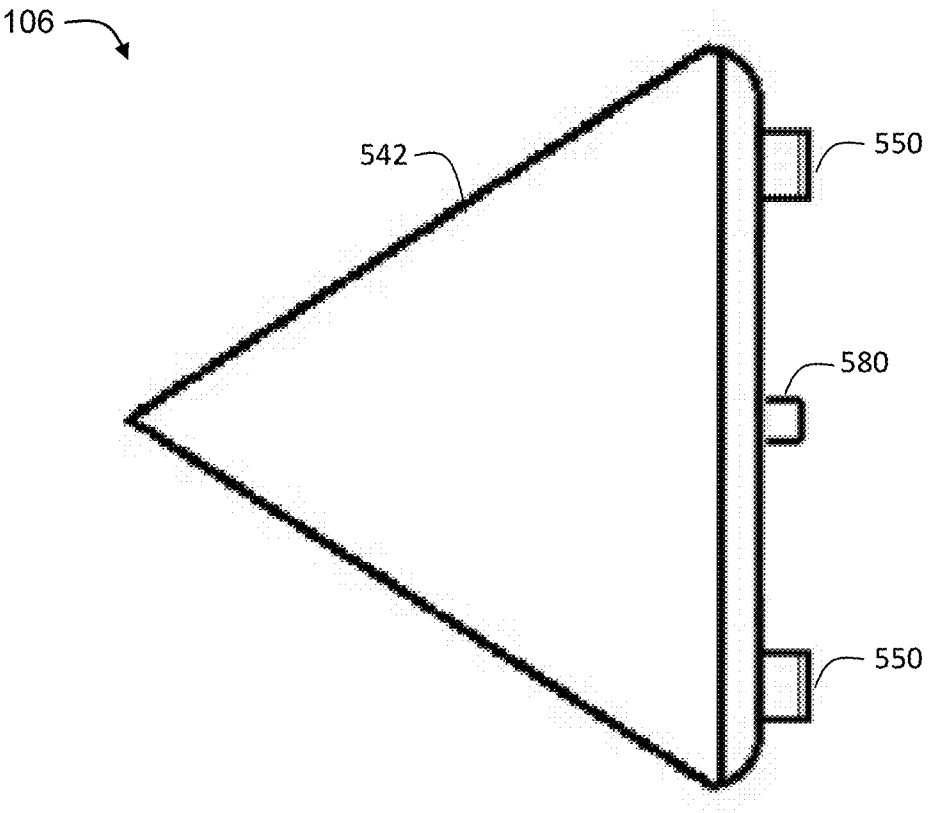
FIG. 9 is a top elevation view schematic diagram of a tail segment of the variable ballast propulsion shipping vessel of FIG. 1.

Referring now to FIG. 9, a tail segment 106 may be characterized by a superstructure comprising a tail body portion 542 that may present a sharp shape to complement the substantially blunt shape of the lead segment's 102 nose cone 202 for the purpose of reducing form drag during movement of the assembled vessel 100, particularly in submerged mode. A forward hinge mechanism 550 may be mounted to a bow of the tail body portion 542, for example, and without limitation, to facilitate mechanical attachment to a last cargo segment 104 of the assembled "train" of vessel segments 100. Similar to the lead segment 102 and cargo segment(s) 104 descriptions above, various accessories mounted on an exterior of tail segment 106 each may be configured as watertight assemblies to prevent water intrusion. For example, and without limitation, a networking cable receptacle 580 may be mounted forward on the tail body portion 542. The reconfigurable bus for delivery of electric power and/or communication signals from lead segment 102 through the "train" of cargo segments 104 to the tail segment 106 may be terminated by using the networking cable receptacle 580 to fittedly receive the networking cable with plug 432 of the last cargo segment 104 in the assembled "train."

The tail segment 106 may further comprise components and systems that may be deployed either partially or fully inside the tail body portion 542 of the tail segment 106. For example, and without limitation, an onboard battery bank (not shown) may be used to power various substantially mechanical systems onboard the tail segment 106 including motors (not shown) used to actuate a deployable drogue (not shown). Other substantially mechanical systems onboard the tail segment 106 and powered by the battery bank (not shown) may include ballast intake(s)/exhaust(s) (not shown) used to selectively receive or expel water into/out of a variable ballast tank(s) (not shown); an air compressor (not shown) used to fill compressed air tank (not shown) from which air may be introduced into the variable ballast tank(s) to expel water for purposes of changing buoyancy of the tail segment 106. The battery bank also may be used to power electronic devices (e.g., actuator/ballast controls, local area networking relays, sensors) found onboard the tail segment 106 that may be largely operated by the shipping vessel control system 320 of the lead segment 102.

Figure 10:
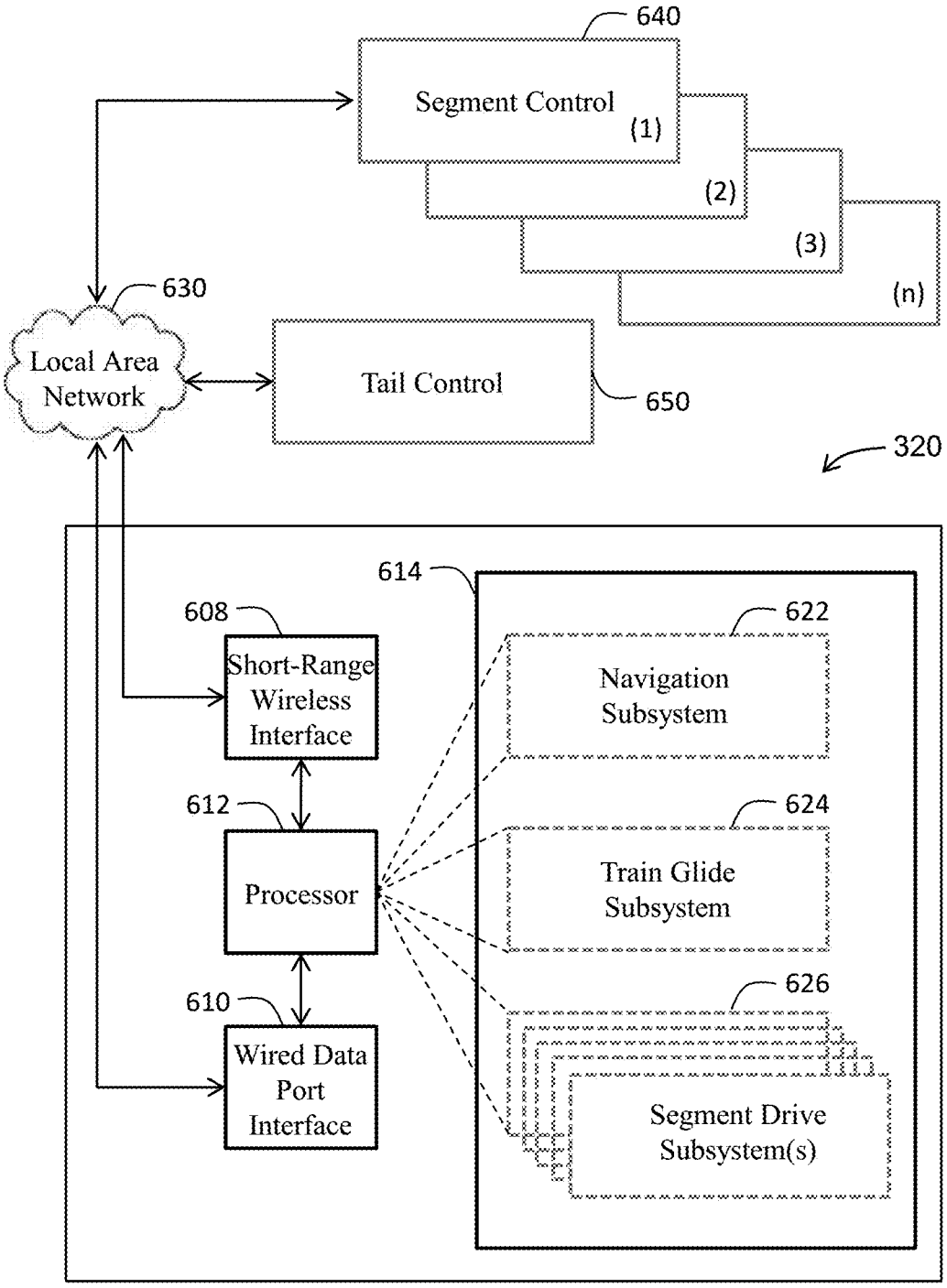
FIG. 10 is a block diagram of a variable ballast propulsion shipping vessel control system according to an embodiment of the present invention.

Referring now to the schematic block diagram of FIG. 10, a variable ballast shipping vessel control system 320 is illustrated in accordance with an exemplary embodiment of the present invention. Those skilled in the art will understand that the principles of the present disclosure may be implemented on or in data communication with any type of suitably arranged device or system configured to automate submerged mode and water surface mode vessel navigation and control.

In the exemplary configuration shown in FIG. 10, the variable ballast shipping vessel control system 320 may comprise a processor 612 (also referred to herein as a "microprocessor" or "central processing unit (CPU)) that may be operable to accept and execute computerized instructions, and also a data store 614 that may store data and instructions used by the processor 612. The processor 612 may be positioned in data communication with electrical/computing devices served by a bus that may be configured to direct input from such devices to the data store 614 for storage and subsequent retrieval. For example, and without limitation, the processor 612 may be configured in data communication with networked resources (e.g., a local area network (LAN) 630) via an underwater-capable short-range wireless interface 608 and/or via a wired data port interface 610. Using such data interfaces, processor 612 may be configured to direct input received from components of the LAN 630 to the data store 614 for storage. Similarly, the processor 612 may be configured to retrieve data from the data store 614 to be forwarded as output to various components of the LAN 630. More specifically, networked components may include each cargo segment's onboard control devices 640 and/or the tail segment's onboard control devices 650.

For example, and without limitation, the computerized instructions of the variable ballast shipping vessel control system 320 may be configured to implement a Navigation Subsystem 622, a Train Glide Subsystem 624, and/or a Segment Drive Subsystem 626 that may be stored in the data store 614 and retrieved by the processor 612 for execution. The Navigation Subsystem 622 may be operable to implement functionality as described below for FIG. 11 related to receipt and execution of a high-level sail plan to guide vessel navigation. The Train Glide Subsystem 624 may be operable to implement functionality as described below for FIG. 11 related to intermediate-level commands to coordinate formation and operation of a set of cargo segments configured as a "train." The Segment Drive Subsystem 626 may be operable to implement functionality as described below for FIG. 13 related to low-level commands to manipulate the local mobility components of each segment of the "train."

Figure 11:
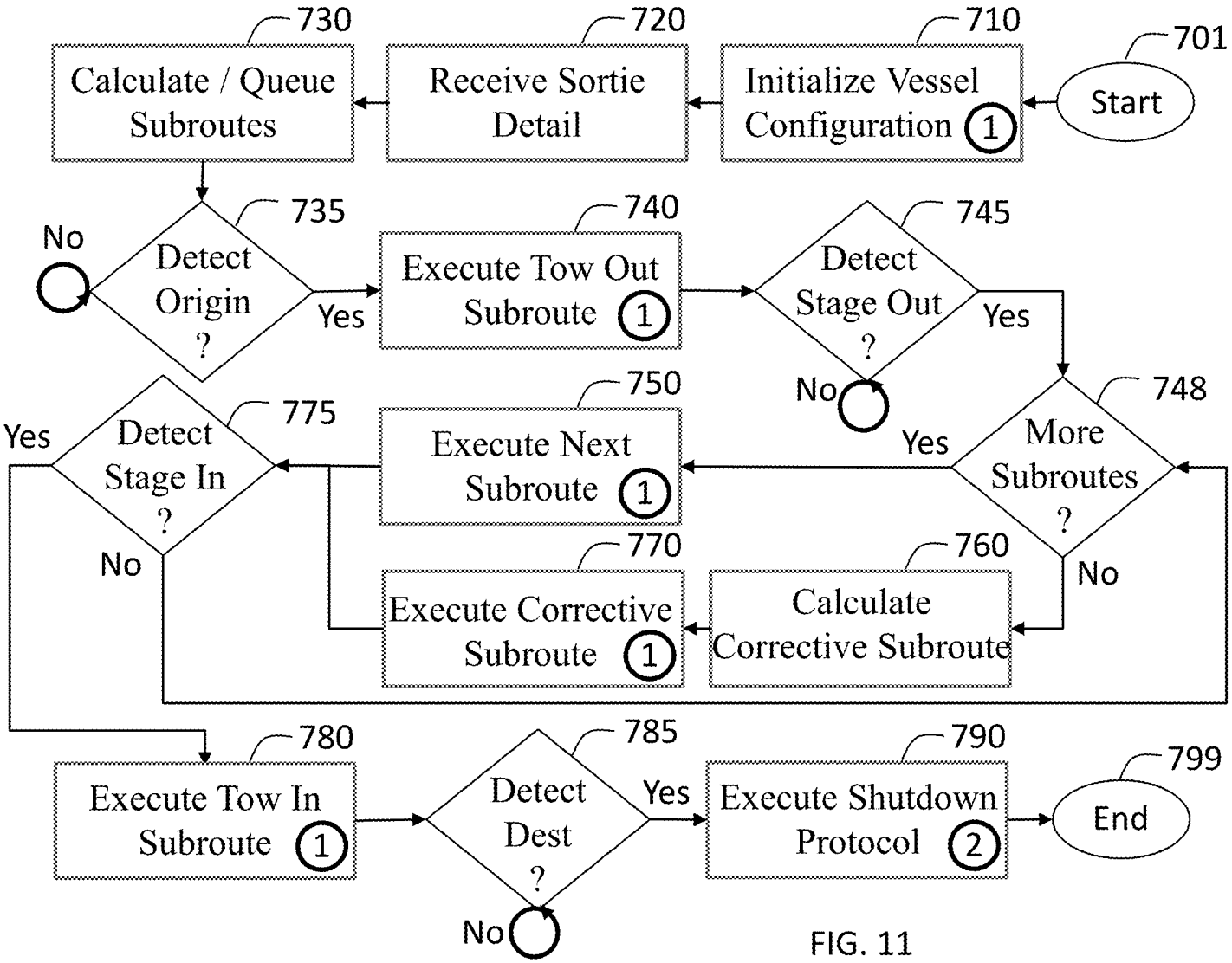
FIG. 11 is a flowchart of exemplary computer-implemented logic for a Navigation Subsystem of the variable ballast propulsion shipping vessel control system of FIG. 8.

Referring now to FIG. 11, a method aspect of Navigation Subsystem 622 will now be described in detail. From the start at Block 701, configuration variables (e.g., number of cargo segments 104 employed; container identifiers and cargo weights/type for each) may be received and processed to initialize the assembled "train" (Block 710). Navigation detail then may be received/retrieved defining a delivery sortie (e.g., origin, destination, preloaded navigation maps, course outline) at Block 720. At Block 730, input sortie details may be used to calculate a detailed delivery course in the form of queued subroutes that collectively span the uninterrupted distance from sortie origin to sortie destination. For example, and without limitation, each subroute may comprise a start waypoint and an end waypoint, between which may be defined an elemental glide maneuver for the assembled "train" (e.g., from an initial peak depth down to trough depth, and back up to a subsequent peak depth).

After a complete set of subroutes is queued and the onboard GPS detects that the "train" is at the sortie origin waypoint (Block 735), the Navigation Subsystem 622 may execute the first sortie in the queue to get underway. As shown at Block 740, the first subroute may be a tow out subroute which may involve moving the assembled "train" in surfaced mode (e.g., towed by one or more tugboats) out of a port of embarkation (e.g., from the sortie origin waypoint) and to a location from which the "train" may begin navigating autonomously (e.g., the next queued subroute's start waypoint). For the duration of the special case tow out subroute, surfaced mode operation may entail the peak depth and trough depth settings for the entire maneuver to remain equal to the unsubmerged draft of the "train" of segments.

At Block 745, Navigation Subsystem 622 may continually monitor "train" location by GPS for the end waypoint of the tow out subroute (also referred to herein as the "stage out" waypoint). Upon detection of stage out reached, the next subroute in the queue may be pulled (Block 748) and executed (Block 750). This pull and execute cycle may continue until the start waypoint of a tow in subroute (also referred to herein as the "stage in" waypoint) is detected at Block 775. Because autonomous operation of an assembled "train" as described above is based on translating synchronized variable buoyancies of the "train" segments into generally forward oscillating motion, most pulled (Block 748) and executed (Block 750) subroutes may define a respective glide maneuver comprising diving the "train" from a start waypoint at a peak depth toward a target trough depth to pick up speed; and then ascending the "train" from the achieved trough depth toward a next target peak depth to complete the elemental glide maneuver.

Special purpose subroutes may be interspersed in a delivery sortie queue to bring one or more of the "train" segments to the water surface (e.g., peak depth and/or trough depth equal to or near the unsubmerged draft) to accomplish certain surface mode operations (e.g., global positioning system (GPS) ping; satellite-based data communications; rendezvous at sea; approach to stage in). Also, in the event that sortie progress fails (e.g., the stage in waypoint is not detected within tolerance at Block 775, but the queue of subroutines is emptied at Block 748), Navigation Subsystem 622 may be configured to dynamically calculate and queue one or more corrective subroutes (Block 760) and to execute these corrective subroute(s) (Block 770) in an attempt to reach the planned stage in waypoint.

When the subroute pull and execute cycle ultimately results in detection of the stage in waypoint (Block 775), the Navigation Subsystem 622 may execute the last subroute in the queue (Block 780), which may be a tow in subroute that may involve moving the assembled "train" in surfaced mode (e.g., towed by one or more tugboats) into a port of debarkation (e.g., at the sortie destination waypoint) where delivered cargo may be offloaded. For the duration of this special case tow in subroute, surfaced mode operation may entail the peak depth and trough depth settings for the entire maneuver to be equal to the unsubmerged draft of the "train" of vessels. When, at Block 785, Navigation System 622 detects arrival at the sortie destination, shutdown protocols may be executed at Block 790 (e.g., compile operations log; capture and upload sortie debrief) before the process ends at Block 799.

Figure 12:
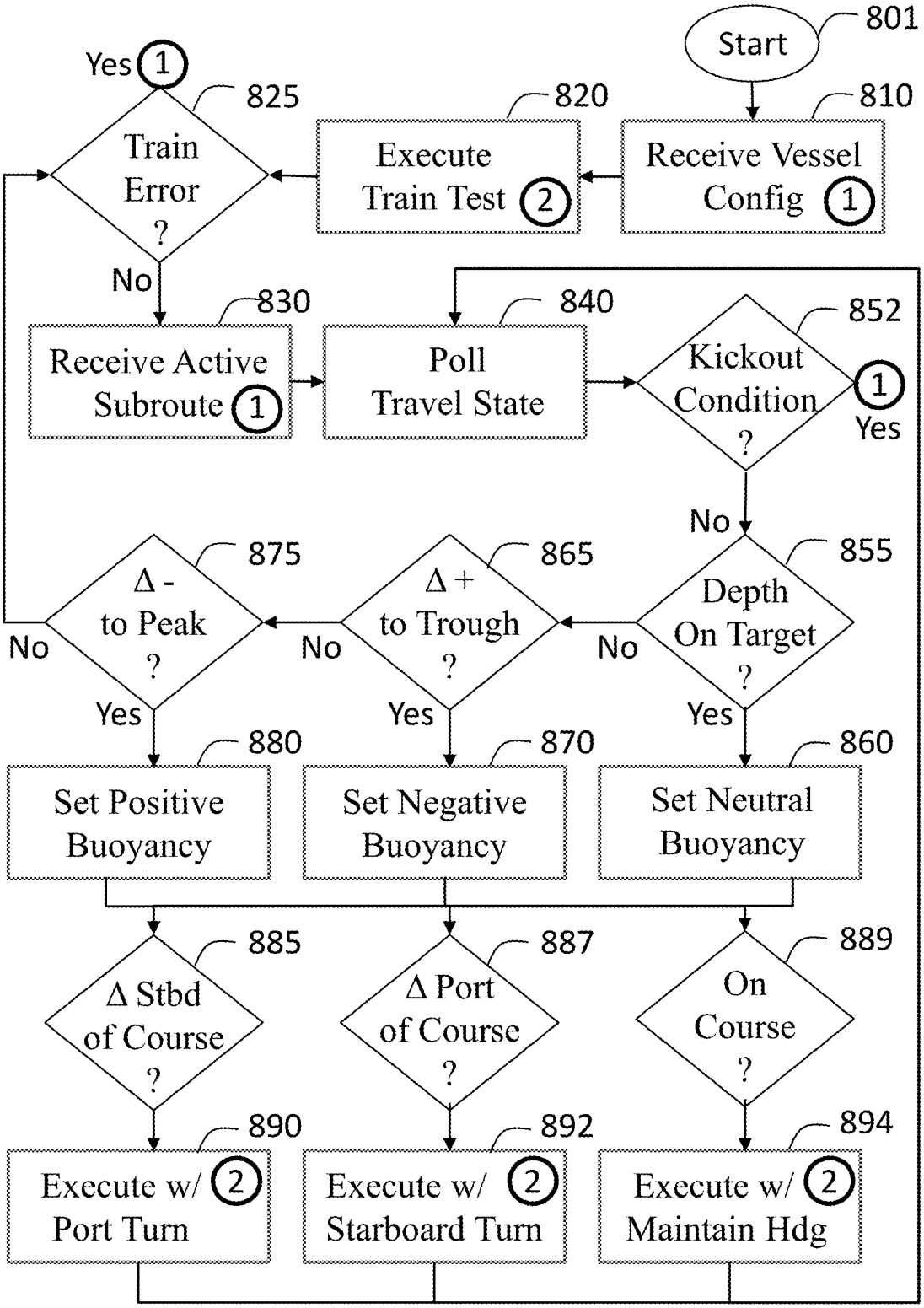
FIG. 12 is a flowchart of exemplary computer-implemented logic for a Train Glide Subsystem of the variable ballast propulsion shipping vessel control system of FIG. 8.

Referring now to FIG. 12, a method aspect of Train Glide Subsystem 624 will now be described in detail. From the start at Block 801, configuration variables forwarded by calling Block 710 of FIG. 11 may be received and used to execute a verification test that the assembled "train" at Block 820 (e.g., configuration meets specifications; inter-segment systems operable and communicating). If an error in train assembly is detected at Block 825, control is returned to the calling Block 710 of FIG. 11 for corrective action. Confirmation of a successful verification test at Block 825 readies the Train Glide Subsystem 624 to receive and process an input subroute.

More specifically, at Block 830, Train Glide Subsystem 624 may receive from calling Block 740 of FIG. 11 the first queued subroute of a delivery sortie to be executed. For example, and without limitation, this first subroute may be a tow out sequence. At Block 840, navigation components onboard the lead segment 102, cargo segment(s) 104, and/or tail segment 106 may be polled to determine real-time travel state variables (e.g., actual position, actual depth, actual heading) to be compared against the active subroute (e.g., target position, target depth, target waypoint). If, at Block 852, an expected kickout condition (e.g., subroute end waypoint and target depth reached) or an unexpected kickout condition is detected (e.g., subroute trough depth exceeded), control may be returned to calling Block 740 of Navigation Subsystem 622 requesting further direction (e.g., next subroute).

Until a kickout condition is detected at Block 852, Train Glide Subsystem 624 may loop through a series of synchronized commands to operate each of the cargo segments 104 to contribute to satisfaction of the input subroute as a "train" assembly. For the tow out subroute, for example, if at Block 855 the actual depth of each segment 102, 104, 106 equates to surface mode (e.g., unsubmerged draft), then all segments 102, 104, 106 may be commanded to execute neutral buoyancy (Block 860). Assuming tow out subroute initial peak and trough are similarly set to surface mode, then detection of an actual depth above the target trough (that is, no longer in the water) may be considered impossible at Block 865. Continuing, if an actual depth below the target peak (e.g., unsubmerged draft) is detected at Block 875, then some or all segments 102, 104, 106 may be commanded to execute positive buoyancy (Block 880) to return the vessel to surface mode. During this simple tow out scenario, the assisting tugboats may be assumed to correctly direct the "train" assembly on course to the end waypoint of the tow out subroute. In response to detecting that the "train" assembly is on course (Block 889), all segments 102, 104, 106 may be commanded to execute maintain heading (Block 894), thereby cooperating with the steering actions of the assisting tugboats.

Arrival at the stage out waypoint may satisfy a kickout condition (Block 852) that prompts Navigation Subsystem 662 to begin looping through active autonomous subroutes (Block 748 at FIG. 9). At Block 830, Train Glide Subsystem 624 may receive from calling Block 740 or Block 750 of FIG. 11 the next queued subroute of the delivery sortie to be executed. As described above, each queued subroute may define a respective glide maneuver comprising diving the "train" from a start waypoint at a target peak depth toward a target trough depth; and then ascending the "train" from the achieved target trough depth toward a next target peak depth to complete the elemental glide maneuver. At Block 840, navigation components 555 (e.g., depth gauges, gyroscopes) onboard the lead segment 102, cargo segment(s) 104, and/or tail segment 106 may be polled to determine real-time travel state variables (e.g., actual position, actual depth, actual course) to be compared against the active subroute (e.g., target waypoint, target trough depth, target peak depths). If, at Block 852, an expected kickout condition (e.g., subroute end waypoint reached) or an unexpected kickout condition is detected (e.g, subroute trough depth exceeded), control may be returned to calling Block 740 requesting further direction (e.g., next subroute).

If at Block 855 the actual depth of each segment 102, 104, 106 matches the target depth, then all segments 102, 104, 106 may be commanded to execute neutral buoyancy (Block 860). If at Block 865 the actual depth of each segment 102, 104, 106 is above the target trough, then each of the "train" segments 102, 104, 106 may be commanded, in rolling sequence forward to aft, to execute negative buoyancy (Block 870) to accomplish the planned descent. If at Block 875 the actual depth of each segment 102, 104, 106 is below the target peak, then each of the "train" segments 102, 104, 106 may be commanded, in rolling sequence forward to aft, to execute positive buoyancy (Block 880) to accomplish the planned ascent. During all buoyancy manipulations (and particularly for descent and ascents), the actual heading of the "train" vessel may be compared against the target course for the active subroute. If at Block 889 the target heading is determined to be on course within a set tolerance, if any, then all segments 102, 104, 106 may be commanded to execute maintain heading (Block 894). If at Block 887 the target heading is determined to be errant to port of the planned course outside a set tolerance, if any, then each of the "train" segments 102, 104, 106 may be commanded, in rolling sequence forward to aft, to execute a turn to starboard (Block 880) to tend back on course. If at Block 885 the target heading is determined to be errant to starboard of the planned course outside a set tolerance, if any, then each of the "train" segments 102, 104, 106 may be commanded, in rolling sequence forward to aft, to execute a turn to port (Block 890) to tend back on course. At Block 852, if either an expected kickout condition (e.g., subroute end waypoint reached) or an unexpected kickout condition is detected (e.g, subroute trough depth exceeded), control may be returned to calling Block 740 with a request for further direction (e.g., next subroute).

Exhausting autonomous operation subroutes routinely may lead to detection of the stage in waypoint of the delivery sortie (Block 775 of FIG. 11) leading to execution of the tow in subroute. More specifically, at Block 830, Train Glide Subsystem 624 may receive from calling Block 780 of FIG. 11 the tow in subroute of the delivery sortie to be executed. At Block 840, navigation components onboard the lead segment 102, cargo segment(s) 104, and/or tail segment 106 may be polled to determine real-time travel state variables (e.g., actual position, actual depth, actual course) to be compared against the tow in subroute (e.g., target waypoint, target trough depth, target peak depths). If, at Block 852, an expected kickout condition (e.g., destination reached) or an unexpected kickout condition is detected (e.g., tow in trough depth exceeded), control may be returned to calling Block 780 requesting further direction (e.g., emergency safety deployment of ballasts).

If at Block 855 the actual depth of each segment 102, 104, 106 equates to surface mode (e.g., unsubmerged draft), then all segments 102, 104, 106 may be commanded to execute neutral buoyancy (Block 860). Assuming tow in subroute initial peak and trough are similarly set to surface mode, then detection of an actual depth above the target trough may be considered impossible at Block 865. Continuing, if an actual depth below the target peak (e.g., unsubmerged draft) is detected at Block 875, then some or all segments 102, 104, 106 may be commanded to execute positive buoyancy (Block 880) to return the vessel to surface mode. During the simple tow in scenario, the assisting tugboats may be assumed to correctly direct the "train" assembly on course to the end waypoint (e.g., sortie destination) of the tow in subroute. In response to detecting that the "train" assembly is on course (Block 889), all segments 102, 104, 106 may be commanded to execute maintain heading (Block 894), thereby cooperating with the steering actions of the assisting tugboats. Arrival at the destination may satisfy a kickout condition (Block 852) that may capture and upload sortie metrics to Navigation Subsystem (Block 785 of FIG. 11) in support of execution of system shutdown protocols (Block 790 at FIG. 11) before the method ends at Block 799.

Figure 13:
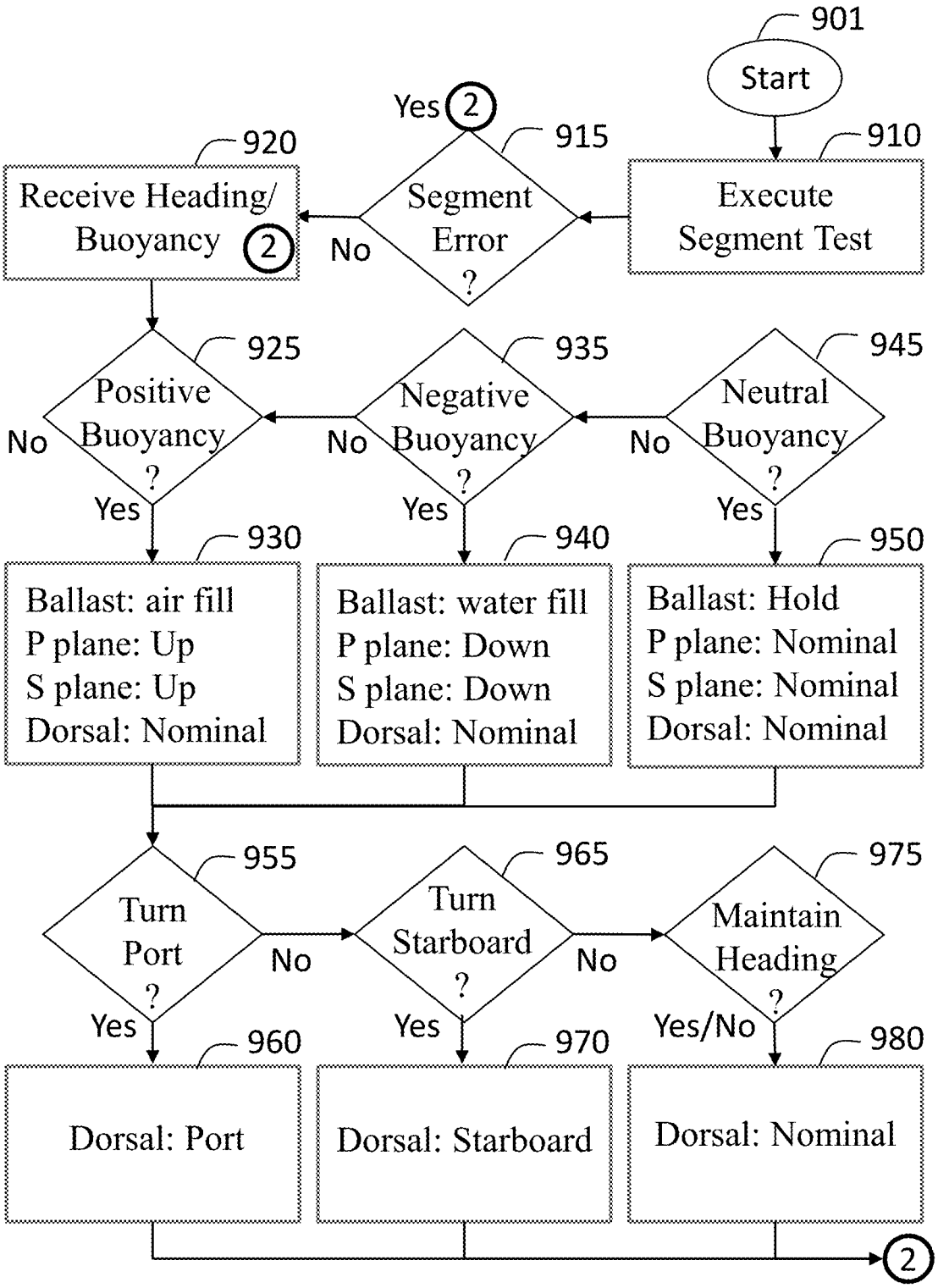
FIG. 13 is a flowchart of exemplary computer-implemented logic for a Segment Drive Subsystem of the variable ballast propulsion shipping vessel control system of FIG. 8.

Referring now to FIG. 13, a method aspect of Segment Drive Subsystem 626 will now be described in detail. A person of skill in the art will appreciate that the independent, yet synchronized, operation of a plurality of cargo segments lends itself to simultaneous execution of multiple instances of Segment Drive Subsystem 626, including employment of multiprocessing. From the start at Block 901, a local systems power up test may be performed for each cargo segment comprising the assembled "train" (Block 901). If any of the segment's tests throws an error, control may be returned to the calling Block 820 of FIG. 12 and, ultimately, to the calling Block 710 of FIG. 11 for corrective action. A successful set of segments tests at their respective Blocks 915 may ready each Segment Drive Subsystem 626 to receive and process an elemental glide maneuver command in support of the active subroute.

More specifically, at Block 920, Segment Drive Subsystem 626 may receive from one of the calling Blocks 890, 892, 894 of FIG. 12 a maneuver command comprising, for example, and without limitation, a buoyancy target and a turn target. If, at Block 925, the buoyancy target of the maneuver command is determined to request an ascend (e.g., positive buoyancy), then at Block 930 onboard local control devices may operate the ballast to fill with air and expel water, may operate the port plane to actuate up; may operate the starboard plane to actuate up; and may operate the dorsal rudder to remain at nominal. If instead, at Block 935, the buoyancy target of the maneuver command is determined to request a descent (e.g., negative buoyancy), then at Block 940 onboard local control devices may operate the variable ballast to fill with water and recapture (e.g., compress and store onboard) the expelled air, may operate the port plane to actuate down; may operate the starboard plane to actuate down; and may operate the dorsal rudder to remain at nominal. If instead, at Block 945, the buoyancy target of the maneuver command is determined to request a depth hold (e.g., neutral buoyancy), then at Block 950 onboard local control devices may operate the variable ballast to remain nominal (e.g., hold steady the existing air and/or water in ballast); may operate the port plane to remain (actuate to) nominal; may operate the starboard plane to remain (actuate to) nominal; and may operate the dorsal rudder to remain at nominal.

The Segment Drive Subsystem 626 may be configured to augment any of the buoyancy actions of Blocks 930, 940, 950 with a complementary turn of the segment, in keeping with the turn target interpreted from the maneuver command. If, at Block 955, the turn target of the maneuver command is determined to request a turn to port, then at Block 960 onboard local control devices may operate the dorsal rudder to actuate to port. If instead, at Block 965, the turn target of the maneuver command is determined to request a turn to starboard, then at Block 970 onboard local control devices may operate the dorsal rudder to actuate to starboard. If instead, at Block 975, the turn target of the maneuver command is determined to request the current course be maintained, then at Block 980 onboard local control devices may operate the dorsal rudder to remain (actuate to) nominal.

A person of skill in the art will immediately recognize that an advantageous implementation of the variable ballast shipping vessel control system 320 may employ any or all of a Navigation Subsystem 622, Train Glide Subsystem 624, and/or Segment Drive Subsystem 626 collocated upon a single host computing device or distributed among two or more host computing devices. For example, and without limitation, the various components of the variable ballast shipping vessel control system 626 may be implemented in an application host/server onboard the lead segment 102. Also for example, and without limitation, the various components of the variable ballast shipping vessel control system 626 may be implemented as redundant and concurrent executables for system reliability.

Those skilled in the art will appreciate that the present disclosure contemplates the use of computer instructions and/or systems configurations that may perform any or all of the operations involved in submersible vessel movement control. The disclosure of computer instructions that include Navigation Subsystem 622 instructions, Train Glide Subsystem 624 instructions, and/or Segment Drive Subsystem 626 instructions is not meant to be limiting in any way. Those skilled in the art will readily appreciate that stored computer instructions and/or systems configurations may be configured in any way while still accomplishing the many goals, features and advantages according to the present disclosure.

Figure 14:
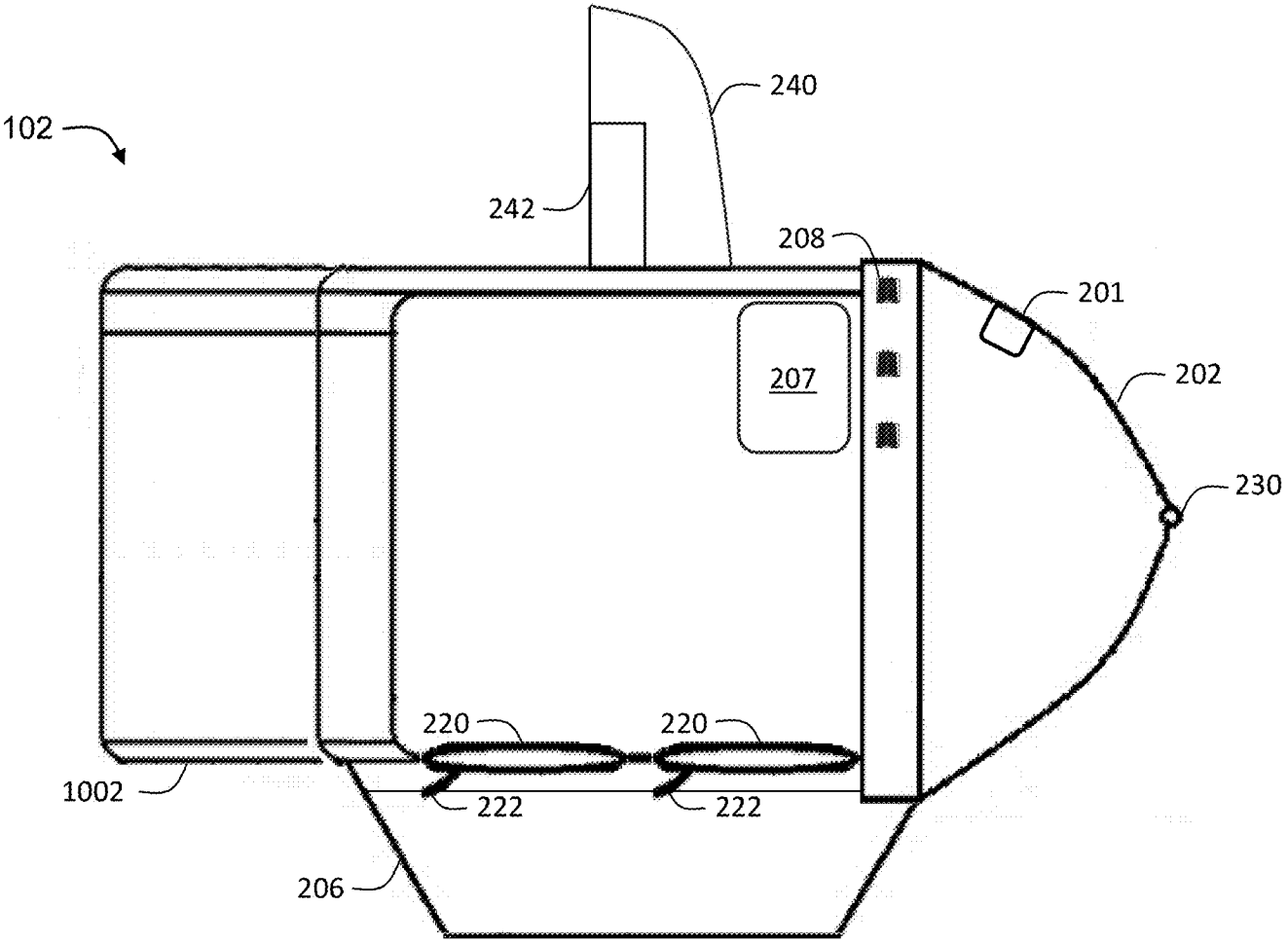
FIG. 14 is a side elevation view schematic diagram of an exemplary slipstream adornment of the lead segment of FIG. 2.
Figure 15:
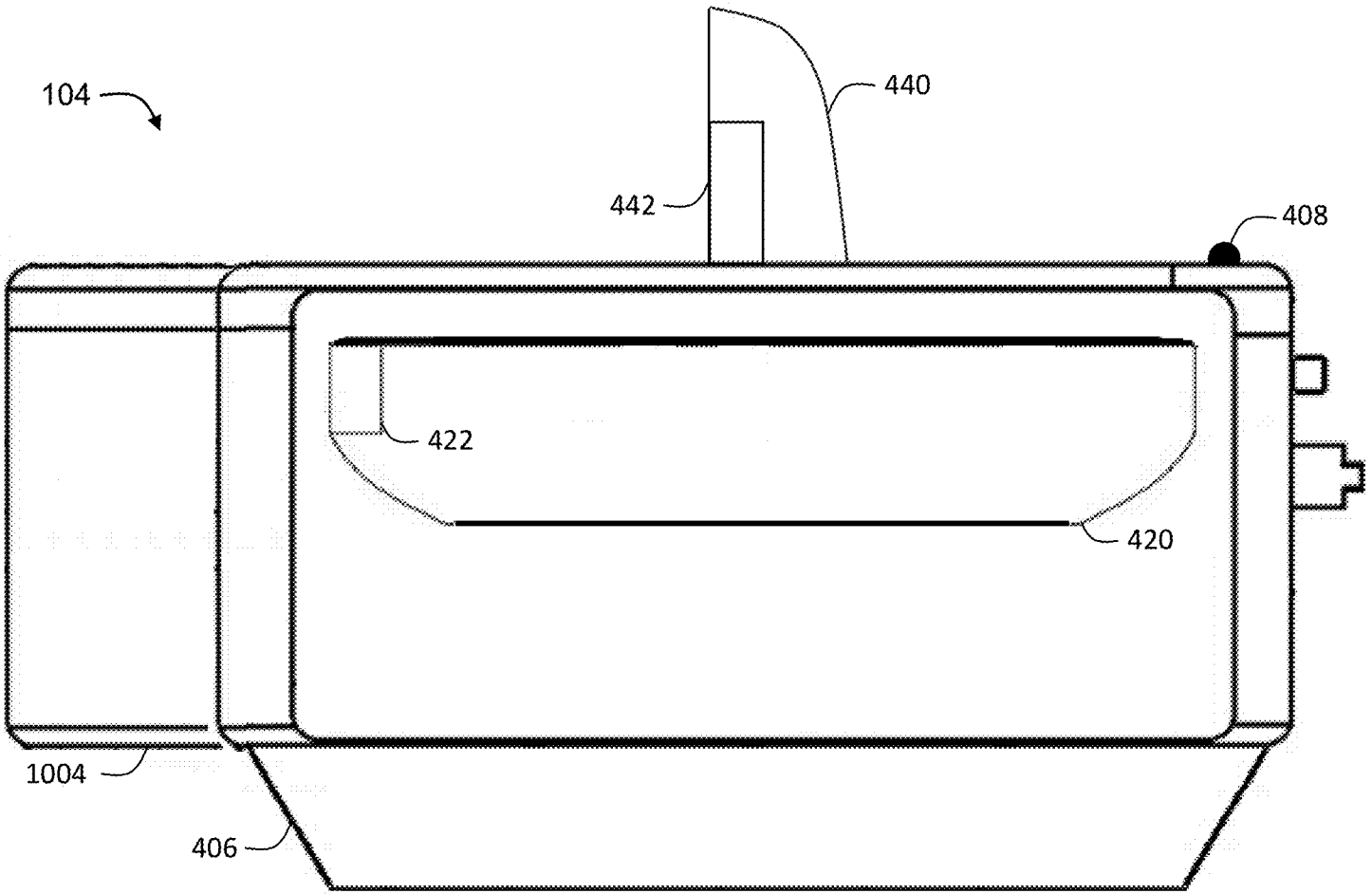
FIG. 15 is a side elevation view schematic diagram of an exemplary slipstream adornment of the cargo segment of FIG. 5 with starboard wing folded.
Figure 16:
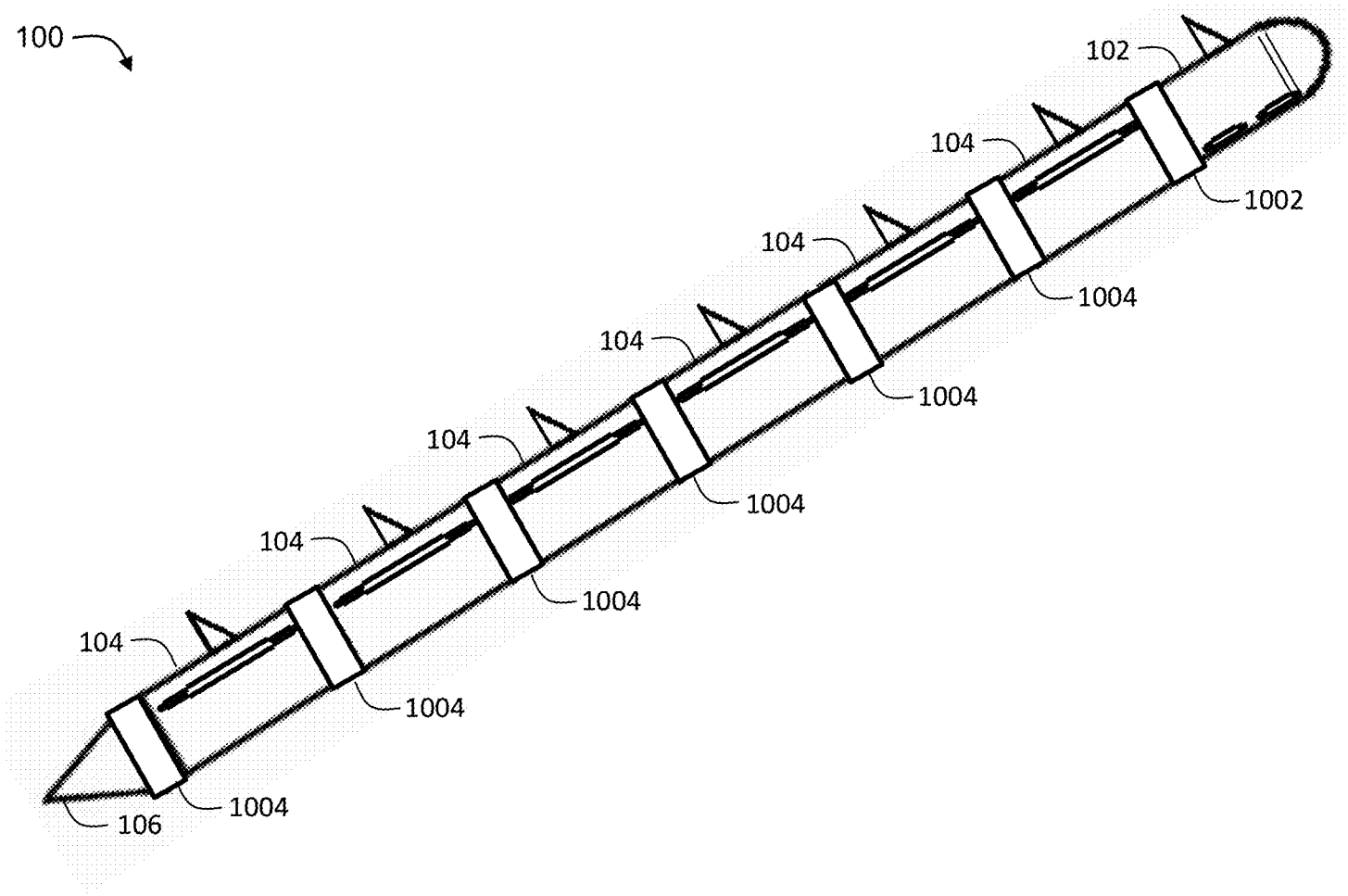
FIG. 16 is a side elevation view schematic diagram of an exemplary slipstream adornment of the variable ballast propulsion shipping vessel of FIG. 1.

Furthermore, those skilled in the art will appreciate that auxiliary components and/or adornments may be added to the designs of the various embodiments of the present invention as described above while still accomplishing the many goals, features and advantages according to the present disclosure. For example, and without limitation, FIGS. 14, 15 and 16 illustrate additional means of reducing form drag during movement of the assembled vessel 100. Specifically, the spatial gap between the lead segment 102 and the immediately adjacent cargo segment 104 may be substantially filled by a lead slipstream cover 1002. Similarly, the respective spatial gaps between each cargo segment 104 and the immediately trailing cargo segment 104 (or, for the last cargo segment 104, the immediately trailing tail segment 106) may be substantially filled by a respective cargo slipstream cover 1004. As shown in FIG. 16, covering of inter-segment gaps with slipstream covers 1002, 1004 may give a variable ballast propulsion shipping vessel 100 of the present invention the "cigar" shape that is common to submarine design, but without compromising the advantageous degrees of freedom of movement between segments that facilitate variable buoyancy vessel propulsion as described hereinabove.

In some embodiments, the method or methods described above may be executed or carried out by a computing system including a tangible computer-readable storage medium, also described herein as a storage machine, that holds machine-readable instructions executable by a logic machine (i.e., a processor or programmable control device) to provide, implement, perform, and/or enact the above-described methods, processes and/or tasks. When such methods and processes are implemented, the state of the storage machine may be changed to hold different data. For example, the storage machine may include memory devices such as various hard disk drives, flash drives, CD, or DVD devices. The logic machine may execute machine-readable instructions via one or more physical information and/or logic processing devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements of the disclosed system and/or method are displayed on a display screen for user consumption. The computing system may include an input subsystem that receives user input. The input subsystem may be configured to connect to and receive input from devices such as a mouse, keyboard or gaming controller. For example, a user input may indicate a request that certain task is to be executed by the computing system, such as requesting the computing system to display any of the above-described information or requesting that the user input updates or modifies existing stored information for processing. A communication subsystem may allow the methods described above to be executed or provided over a computer network. For example, the communication subsystem may be configured to enable the computing system to communicate with a plurality of personal computing devices. The communication subsystem may include wired and/or wireless communication devices to facilitate networked communication. The described methods or processes may be executed, provided, or implemented for a user or one or more computing devices via a computer-program product such as via an application programming interface (API).

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A variable ballast propulsion shipping vessel [100], comprising:

at least one cargo segment [104] including:

a cargo segment body [403], a fixed ballast [406] mounted on a bottom of the cargo segment body [403], a pair of side wings [420] correspondingly mounted on and projecting laterally from opposing sides of the cargo segment body [403] and each having a respective plane [422], a dorsal wing [440] mounted on a top of the cargo segment body [403] and having a rudder [442], and a first variable ballast tank [504]; and a lead segment [102] mechanically and hingedly attached forward of the at least one cargo segment [104] in a series, the lead segment [102] including:

a lead segment body [203], and a second variable ballast tank [304]; and a shipping vessel control system [320] configured to:

receive a subroute [830] including a target peak, a target trough, a target course, and a target waypoint; and create control commands to selectively operate at least one of the first variable ballast tank [504] and the second variable ballast tank [304] to alter a respective travel state [840] of the at least one cargo segment [104] and the lead segment [102] respectively among a positive buoyancy [930], a negative buoyancy [940], and a neutral buoyancy [950], based on the subroute [830].

2. The variable ballast propulsion shipping vessel [100] according to claim 1, wherein the at least one cargo segment [104] further comprises a battery bank [512] configured to deliver power to at least one of a respective actuator motor of the rudder [442] and of the plurality of planes [422].

3. The variable ballast propulsion shipping vessel [100] according to claim 2, wherein the at least one cargo segment [104] further comprises a battery charger [510] configured to translate current from at least one impeller [408] for storage into the battery bank [512].

4. The variable ballast propulsion shipping vessel [100] according to claim 1, wherein the at least one cargo segment [104] further comprises a compressed air compartment [506] configured to transfer air into the first variable ballast tank [504]: an air compressor [505] configured to air fill the compressed air compartment [506]; and at least one ballast port [502] configured both to water intake and to water exhaust the first variable ballast tank [504].

5. The variable ballast propulsion shipping vessel [100] according to claim 1, wherein the shipping vessel control system [320] is configured in data communication with each of the at least one cargo segment [104] by at least one of:

a wired interface [610] coupled to a communications bus comprising a networking receptacle [430] and a networking cable/plug [432]; and a wireless interface [610].

6. The variable ballast propulsion shipping vessel [100] according to claim 1, wherein the at least one cargo segment [104] further comprises at least one hatch [405] positioned for top access to a cargo bay [455] within the cargo segment body [403].

7. The variable ballast propulsion shipping vessel [100] according to claim 1, wherein the at least one cargo segment [104] further comprises a plurality of cargo segments [104] mechanically and hingedly attached in the series.

8. The variable ballast propulsion shipping vessel [100] according to claim 7, further comprising a tail segment [106] mechanically and hingedly attached to the plurality of cargo segments [104] aft of the series.

9. The variable ballast propulsion shipping vessel [100] according to claim 1, wherein the lead segment [102] further comprises:

a fixed ballast [206] mounted on a bottom of the lead segment body [203], a plurality of side wings [220] pair mounted on and projecting laterally from opposing sides of the lead segment body [203] and each having a respective plane [222], a dorsal wing [240] mounted on a top of the lead segment body [203] and having a rudder [242].

10. The variable ballast propulsion shipping vessel [100] according to claim 9, wherein the lead segment [102] further comprises a battery bank [312] configured to deliver power the shipping vessel control system [320].

11. The variable ballast propulsion shipping vessel [100] according to claim 1, wherein at least one of the pair of side wings [420] is of a stowage type selected from the group consisting of a retracting type and a folding type.

12. The variable ballast propulsion shipping vessel 11001 according to claim 7, further comprising a slipstream cover [1004] mounted between an adjacent pair of the plurality of cargo segments [104].

13. A system for controlling a variable ballast propulsion shipping vessel [1001, the system comprising:

a shipping vessel control system [320] utilizing a computer processor [612] and a non-transitory computer-readable storage medium [614] including a plurality of instructions which, when executed by the computer processor 612], are configured to selectively operate at least one cargo segment [104] of a variable ballast propulsion shipping vessel [100] by;

receiving a subroute [830] including a target peak, a target trough, a target course, and a target waypoint;

operating, while polling a travel state [840] having an actual position not equal to the target waypoint [852], each of the at least one cargo segment [104], in turn, as mechanically and hingedly attached in a series, by:

transmitting, upon detection of an on target condition between a target depth [855] and an actual depth of the travel state [840], a set neutral buoyancy command [860];

transmitting, upon detection of a positive delta between the target trough [865] and the actual depth of the travel state [840], a set negative buoyancy command [870]; and transmitting, upon detection of a negative delta between the target peak [875] and the actual depth of the travel state [840], a set positive buoyancy command [880], wherein, the at least one cargo segment [104] includes:

a cargo segment body [403], a pair of side wings [420] correspondingly mounted on and projecting laterally from opposing sides of the cargo segment body [403] and each having a respective plane [422], a dorsal wing [440] mounted on a top of the cargo segment body [403] having a rudder [442], and a first variable ballast tank [504], the system further including:

operating, upon receiving the set positive buoyancy command [925], one of the plurality of cargo segments [104] by air filling the first variable ballast [504], pairedly articulating the planes [422] to up position, and articulating the rudder [442] to laterally nominal position [930];

operating, upon receiving the set negative buoyancy command [935], the one of the plurality of cargo segments [104] by water filling the first variable ballast [504], pairedly articulating the planes [422] to down position, and articulating the rudder [442] to the laterally nominal position [940]; and operating, upon receiving the set neutral buoyancy command [945], the one of the plurality of cargo segments [104] by holding the first variable ballast [504], pairedly articulating the planes [422] to vertically nominal position, and articulating the rudder [442] to the laterally nominal position [940].

14. A system for controlling a variable ballast propulsion shipping vessel [100], the system comprising:

a shipping vessel control system [320] utilizing a computer processor [612] and a non-transitory computer-readable storage medium [614] including a plurality of instructions which, when executed by the computer processor [612], are configured to selectively operate at least one cargo segment [104] of a variable ballast propulsion shipping vessel [100] by;

receiving a subroute [830] including a target peak, a target trough, a target course, and a target waypoint;

operating, while polling a travel state [840] having an actual position not equal to the target waypoint [852], each of the at least one cargo segment [104], in turn, as mechanically and hingedly attached in a series, by:

transmitting, upon detection of an on target condition between a target depth [855] and an actual depth of the travel state [840], a set neutral buoyancy command [860];

transmitting upon detection of a positive delta between the target trough [865] and the actual depth of the travel state [840], a set negative buoyancy command [870]; and transmitting, upon detection if a negative delta between the target peak [875] and the actual depth of the travel state [840], a set positive buoyancy command [880], further comprising:

operating, while polling the travel state [840] having the position not equal to the target waypoint [852], each of the at least one cargo segments [104], in turn, as mechanically and hingedly attached in the series, by:

transmitting, upon detection of an on course condition between a target course [889] and an actual heading of the travel state [840], a maintain heading command [894];

transmitting, upon detection of a port delta between a target course [887] and the actual heading of the travel state [840], a starboard turn command [892]; and transmitting, upon detection of a starboard delta between a target course [885] and the actual heading of the travel state [840], a port turn command [890].

15. The system according to claim 14, further comprising:

operating, upon receiving the port turn command [955], one of the plurality of cargo segments [104] by articulating the rudder [442] to port position [960];

operating, upon receiving the starboard turn command [965], the one of the plurality of cargo segments [104] by articulating the rudder [442] to starboard position [970]; and operating, upon receiving the maintain heading command [975], the one of the plurality of cargo segments [104] by articulating the rudder [442] to the laterally nominal position [980].

16. A method of operating a variable ballast propulsion shipping vessel [100] including a plurality of cargo segments [104] mechanically and bingedly attached in a series; the method comprising:

receiving a subroute [830] including a target peak, a target trough, a target course, and a target waypoint;

operating, while polling a travel state [840] having an actual position not equal to the target waypoint [852], each of the plurality of cargo segments [104], in turn, by:

transmitting, upon detection of an on target condition between a target depth [855] and an actual depth of the travel state [840], a set neutral buoyancy command [860];

transmitting, upon detection of a positive delta between the target trough [865] and the actual depth of the travel state [840], a set negative buoyancy command [870];

and transmitting, upon detection of a negative delta between the target peak [875] and the actual depth of the travel state [840], a set positive buoyancy command [880], operating, upon receiving the set positive buoyancy command [925], one of the plurality of cargo segments [104] by air filling a first variable ballast [504], articulating a plane pair [422] to up position, and articulating a dorsal rudder [442] to laterally nominal position [930];

operating, upon receiving the set negative buoyancy command [935], the one of the plurality of cargo segments [104] by water filling the first variable ballast [504], articulating the plane pair [422] to down position, and articulating the dorsal rudder [442] to the laterally nominal position [940]; and operating, upon receiving the set neutral buoyancy command [945], the one of the plurality of cargo segments [104] by holding the first variable ballast [504], articulating the plane pair [422] to vertically nominal position, and articulating the dorsal rudder [442] to the laterally nominal position [940].

17. A method of operating a variable ballast propulsion shipping vessel [100] including a plurality of cargo segments [104] mechanically and hingedly attached in a series; the method comprising:

receiving a subroute [830] including a target peak, a target trough, a target course, and a target waypoint;

operating, while polling a travel state [840] having an actual position not equal to the target waypoint [852], each of the plurality of cargo segments [104], in turn, by:

transmitting, upon detection of an on target condition between a target depth [855] and an actual depth of the travel state [840], a set neutral buoyancy command [860];

transmitting, upon detection of an on target condition between a target depth [865] and the actual depth of the travel state [840], a set negative buoyancy command [870];

and transmitting, upon detection of a negative delta between the target peak [875] and the actual depth of the travel state [840], a set positive buoyancy command [880], operating, while polling the travel state [840] having the position not equal to the target waypoint [852], each of the plurality of cargo segments [104], in turn, by:

transmitting, upon detection of an on course condition between the target course [889] and an actual heading of the travel state [840], a maintain heading command [894];

transmitting, upon detection of a port delta between the target course [887] and the actual heading of the travel state [840], a starboard turn command [892]; and transmitting, upon detection of a starboard delta between the target course [885] and the actual heading of the travel state [840], a port turn command [890].

18. The method according to claim 17, further comprising:

operating, upon receiving the port turn command [955], one of the plurality of cargo segments [104] by articulating the dorsal rudder [442] to port position [960];

operating, upon receiving the starboard turn command [965], the one of the plurality of cargo segments [104] by articulating the dorsal rudder [442] to starboard position [970]; and operating, upon receiving the maintain heading command [975], the one of the plurality of cargo segments [104] by articulating the dorsal rudder [442] to the laterally nominal position [980].

* * * * *